US010573250B2

(12) United States Patent
Miyata et al.

(10) Patent No.: US 10,573,250 B2
(45) Date of Patent: Feb. 25, 2020

(54) LIQUID CRYSTAL DISPLAY DEVICE AND DRIVING METHOD THEREFOR

(71) Applicant: SHARP KABUSHIKI KAISHA, Sakai, Osaka (JP)

(72) Inventors: Hidekazu Miyata, Sakai (JP); Masamitsu Kobayashi, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 69 days.

(21) Appl. No.: 15/737,249

(22) PCT Filed: Jun. 10, 2016

(86) PCT No.: PCT/JP2016/067343
§ 371 (c)(1),
(2) Date: Dec. 15, 2017

(87) PCT Pub. No.: WO2016/204085
PCT Pub. Date: Dec. 22, 2016

(65) Prior Publication Data

US 2018/0130428 A1 May 10, 2018

(30) Foreign Application Priority Data

Jun. 19, 2015 (JP) ..... 2015-123451

(51) Int. Cl.
*G09G 3/34* (2006.01)
*G09G 3/36* (2006.01)
*G09G 3/20* (2006.01)

(52) U.S. Cl.
CPC ..... *G09G 3/3413* (2013.01); *G09G 3/2003* (2013.01); *G09G 3/2022* (2013.01);
(Continued)

(58) Field of Classification Search
CPC ... G09G 2310/0235; G09G 2310/0264; G09G 2310/08; G09G 2340/16;
(Continued)

(56) References Cited

U.S. PATENT DOCUMENTS 6,492,969 B1 12/2002 Budzelaar
2004/0246242 A1* 12/2004 Sasaki ..... G09G 3/342 345/204

(Continued)

FOREIGN PATENT DOCUMENTS

JP 2003-502687 A 1/2003
WO 2003/098588 A1 11/2003

*Primary Examiner* — Kwin Xie
(74) *Attorney, Agent, or Firm* — ScienBiziP, P.C.

(57) ABSTRACT

A liquid crystal display device of a time division driving system, capable of preventing an occurrence of a color shift without causing flickering or image sticking, is achieved. The liquid crystal display device includes: a stable arrival gradation data acquisition unit (122) configured to acquire stable arrival gradation data indicating an arrival gradation estimation value at a start timing of each field of the last frame, in a case where a virtual display process of three or more frames is performed based on input gradation data for one frame; and an input gradation data compensation unit configured to acquire writing gradation data by compensating the input gradation data based on the stable arrival gradation data. The stable arrival gradation data acquisition unit (122) includes a plurality of arrival gradation value estimation circuits (123) each being configured to perform an arrival gradation value estimation process (a process for acquiring an arrival gradation estimation value at the start timing of a next field, based on input gradation data for an object field and an arrival gradation estimation value at the start timing of the object field).

12 Claims, 25 Drawing Sheets

(52) U.S. Cl.
CPC ..... *G09G 3/3648* (2013.01); *G09G 3/3688* (2013.01); *G09G 3/3677* (2013.01); *G09G 2310/0235* (2013.01); *G09G 2310/0264* (2013.01); *G09G 2310/08* (2013.01); *G09G 2320/0242* (2013.01); *G09G 2320/0247* (2013.01); *G09G 2320/0252* (2013.01); *G09G 2320/0276* (2013.01); *G09G 2320/064* (2013.01); *G09G 2340/16* (2013.01)

(58) Field of Classification Search
CPC ... G09G 2320/0242; G09G 2320/0247; G09G 2320/0252; G09G 2320/0276; G09G 2320/064; G09G 3/2003; G09G 3/2022; G09G 3/3413; G09G 3/3648; G09G 3/3677; G09G 3/368
USPC ..... 345/87–104
See application file for complete search history.

(56) References Cited

U.S. PATENT DOCUMENTS

| | | | | |
|---|---|---|---|---|
| 2005/0162359 | A1 | 7/2005 | Sugino | |
| 2005/0168490 | A1* | 8/2005 | Takahara | G09G 3/2014 345/690 |
| 2009/0189924 | A1* | 7/2009 | Ogura | G09G 3/3233 345/690 |
| 2010/0244029 | A1* | 9/2010 | Yamazaki | H01L 27/1225 257/52 |
| 2010/0265281 | A1* | 10/2010 | Furukawa | G09G 3/3413 345/691 |
| 2016/0104444 | A1* | 4/2016 | Miyata | G09G 3/3406 345/205 |

* cited by examiner

| GRADATION VALUE (8bit) | LUMINANCE VALUE ($cd/m^2$) |
|---|---|
| 0 | 0. 053 |
| 1 | 0. 054 |
| 2 | 0. 055 |
| ⋮ | ⋮ |
| 253 | 73. 133 |
| 254 | 73. 770 |
| 255 | 74. 410 |

FIG. 4

ARRIVAL GRADATION VALUE AT START TIMING OF OBJECT FIELD

INPUT GRADATION VALUE OF OBJECT FIELD

| | 0 | 32 | 64 | 96 | 128 | 160 | 192 | 224 | 255 |
|---|---|---|---|---|---|---|---|---|---|
| 0 | 0 | 0 | 0 | 0 | 0 | 0 | 0 | 0 | 0 |
| 32 | 34 | 32 | 30 | 26 | 17 | 0 | 0 | 0 | 0 |
| 64 | 68 | 64 | 64 | 60 | 53 | 43 | 30 | 1 | 0 |
| 96 | 105 | 104 | 100 | 96 | 88 | 73 | 59 | 32 | 0 |
| 128 | 157 | 152 | 144 | 139 | 128 | 112 | 93 | 59 | 18 |
| 160 | 240 | 236 | 235 | 230 | 210 | 160 | 131 | 91 | 39 |
| 192 | 255 | 255 | 255 | 255 | 255 | 236 | 192 | 130 | 77 |
| 224 | 255 | 255 | 255 | 255 | 255 | 255 | 255 | 224 | 162 |
| 255 | 255 | 255 | 255 | 255 | 255 | 255 | 255 | 255 | 255 |

| | 0 | 32 | 64 | 96 | 128 | 160 | 192 | 224 | 255 |
|---|---|---|---|---|---|---|---|---|---|
| 0 | | | | | | | | | |
| 32 | | | | | | | | | |
| 64 | | | | | | | | | |
| 96 | | | | | | | | | |
| 128 | | | | | | | | | |
| 160 | | | | | | | | | |
| 192 | | | | | | | | | |
| 224 | | | | | | | | | |
| 255 | | | | | | | | | |

84

FIG. 8

ARRIVAL GRADATION VALUE AT START TIMING OF OBJECT FIELD

APPLICATION GRADATION VALUE OF OBJECT FIELD

| | 0 | 32 | 64 | 96 | 128 | 160 | 192 | 224 | 255 |
|---|---|---|---|---|---|---|---|---|---|
| 0 | ··· | ··· | ··· | ··· | ··· | ··· | ··· | ··· | ··· |
| 32 | ··· | ··· | ··· | ··· | ··· | ··· | ··· | ··· | ··· |
| 64 | ··· | ··· | ··· | ··· | ··· | ··· | ··· | ··· | ··· |
| 96 | ··· | ··· | ··· | ··· | ··· | ··· | ··· | ··· | ··· |
| 128 | ··· | ··· | ··· | ··· | ··· | ··· | ··· | ··· | ··· |
| 160 | ··· | ··· | ··· | ··· | ··· | ··· | ··· | ··· | ··· |
| 192 | ··· | ··· | ··· | ··· | ··· | ··· | ··· | ··· | ··· |
| 224 | ··· | ··· | ··· | ··· | ··· | ··· | ··· | ··· | ··· |
| 255 | ··· | ··· | ··· | ··· | ··· | ··· | ··· | ··· | ··· |

FIG. 9

LIQUID CRYSTAL DISPLAY DEVICE AND DRIVING METHOD THEREFOR

TECHNICAL FIELD

The present invention relates to a liquid crystal display device, and more specifically, relates to a technique for preventing an occurrence of a color shift in a liquid crystal display device employing a time division driving system (for example, a system for driving a liquid crystal by dividing one frame period into a plurality of fields (subframes), such as a field sequential system).

BACKGROUND ART

In a liquid crystal display device configured to perform color display, one pixel is typically divided into three sub pixels: a red pixel including a color filter for transmitting red light, a green pixel including a color filter for transmitting green light, and a blue pixel including a color filter for transmitting blue light. The color filters provided in these three sub pixels allow color display; however, about ⅔ of backlight irradiated onto a liquid crystal panel is absorbed by the color filters. Therefore, in such a liquid crystal display device employing a color filter system, a light utilization efficiency may be low. Therefore, field sequential liquid crystal display devices for color display without using a color filter attract attention.

In a typical liquid crystal display device employing the field sequential system, one frame period that is a display period for one screen is divided into three fields. Note that a field may also be referred to as a subframe; however, in a description below, the term "field" will be used in a unified manner. For example, one frame period is divided into a field for displaying a red screen based on a red component of an input image signal (a red field), a field for displaying a green screen based on a green component of an input image signal (a green field), and a field for displaying a blue screen based on a blue component of an input image signal (a blue field). By displaying primary colors one by one as described above, a color image is displayed on a liquid crystal panel. As a color image is displayed in this way, the need of a color filter is eliminated in a field sequential liquid crystal display device. Accordingly, the light utilization efficiency is about three times higher in such a field sequential liquid crystal display device than in a liquid crystal display device employing a color filter system. Thus, the field sequential liquid crystal display device is suitable for achieving high luminance and low power consumption.

Note that, in the present specification, a combination of a data value of a red component, a data value of a green component, and a data value of a blue component is referred to as "an RGB combination". For example, one RGB combination is "R=128, G=32, B=255". In this example, the data value of the red component is 128, the data value of the green component is 32, and the data value of the blue component is 255. Typically, the data value is a gradation value.

However, in a liquid crystal display device, an image is displayed by controlling a transmittance of each pixel using voltage (a liquid crystal applied voltage). Relating to this, it takes several milliseconds from a time when writing of data into a pixel (application of voltage) starts to a time when the transmittance is at or higher than a target transmittance in the pixel. Therefore, after a liquid crystal in each field responds to a certain extent, the backlight of each color switches from off state to on state, in a field sequential liquid crystal display device.

Furthermore, in a liquid crystal display device, due to a low response speed of a liquid crystal, in a case of displaying, for example, a video, a sufficient image quality cannot be achieved. Therefore, in the related art, as a solution to the low response speed of a liquid crystal, a driving system called overdrive (over shoot driving) is employed. In the overdrive, in accordance with a combination of a data value of an input image signal of an immediately preceding frame and a data value of an input image signal of a current frame, a drive voltage higher than a gradation voltage determined in advance corresponding to the data value of the input image signal of the current frame, or a drive voltage lower than the gradation voltage determined in advance corresponding to the data value of the input image signal of the current frame, is supplied to the liquid crystal panel. That is, by using the overdrive, a compensation for emphasizing a temporal change (not a spatial change) of the data value is carried out for the input image signal. By employing such overdrive, in an existing liquid crystal display device employing a color filter system, a liquid crystal makes a response such that the transmittance in each frame reaches at or higher than approximately a target value (a target transmittance).

Note that the transmittance of a pixel depends on a liquid crystal state (an orientation state of liquid crystal molecules) in the pixel. In the following description, a gradation value corresponding to the transmittance of a liquid crystal state at each time point is referred to as "a liquid crystal state level", and the "liquid crystal state level" at a start timing (an end timing for an immediately preceding period) of each period (each field) is referred to as "an arrival gradation value".

Typically, in a liquid crystal display device that employs the overdrive, the transmittance is assumed to be at or higher than a target value within one frame period. However, depending on a response characteristic of a liquid crystal to be used, the transmittance may not be at or higher than the target value within one frame period. In this case, based on the determination of a drive voltage without considering a change in the transmittance in the immediately preceding frame, a difference between the target value and an actually achieved transmittance may become gradually larger. WO 2003/098588 discloses an invention of a liquid crystal display device capable of providing a solution to this phenomenon. In the liquid crystal display device, arrival gradation data indicating an arrival gradation value (arrival gradation luminance) at the start timing of the current frame is obtained, based on an input image signal of an immediately preceding frame. Then, a drive voltage is determined based on the arrival gradation data and the input image signal of the current frame. By determining the drive voltage in consideration of the arrival gradation value in this manner, an occurrence of an afterimage is prevented and gray levels are correctly displayed, for video images having any type of gradation transition.

Furthermore, JP 2003-502687 T discloses an invention relating to a compensation operation for a color impurity in a color sequential LCD image display device. According to the above-described invention, a signal of each color is compensated based on a signal of a preceding color. For example, in a case where colors are displayed in an order of "blue, green, and red", a signal of green is compensated based on a signal of blue.

CITATION LIST

Patent Literature

PTL 1: WO 2003/098588
PTL 2: JP 2003-502687 T

SUMMARY OF INVENTION

Technical Problem

As described above, by employing the overdrive in the existing liquid crystal display device of a color filter system, the liquid crystal makes responses such that the transmittance in each field is at or higher than approximately the target value. This provides a sufficient image quality. However, in a field sequential liquid crystal display device, even when the transmittance in each field is at or higher than a target value by the overdrive, a sufficient image quality is not achieved for the reason below. As described above, the backlight switches from off state to on state at any point of each field in the field sequential liquid crystal display device. However, at the start timing of on state of the backlight, the transmittance is not at or higher than the target value, and thus, the liquid crystal state (an orientation state of liquid crystal molecules) changes even during a backlight lighting period. Therefore, the liquid crystal state at the end timing of each field and the luminance (display luminance) actually displayed in each field are not in a one-to-one correspondence relationship. Thus, in the known overdrive, it is not possible to suitably control a color balance (chromaticity) to be displayed in each field. As a result, a color shift occurs. Even in a case where the transmittance is at or higher than a target value by the overdrive in each field in a field sequential liquid crystal display device, a sufficient image quality cannot be not achieved.

Here, it is assumed that the color of an RGB combination "R=128, G=128, B=32" is displayed in a liquid crystal display device using gradation data of eight bits for each color. Note that in FIG. 29 to FIG. 31, a lighting period of a red backlight is expressed by a reference sign TR, a lighting period of a green backlight is expressed by a reference sign TG, and a lighting period of a blue backlight is expressed by a reference sign TB. Furthermore, in FIG. 29 to FIG. 31, a change in the liquid crystal state is expressed by a change in the arrival gradation value.

In a case where the liquid crystal molecules have an ideal response characteristic, that is, in a case where a response time of the liquid crystal is always zero when the field is switched, even when the overdrive is not employed, the liquid crystal state level changes as indicated bold lines as a reference sign 91 in FIG. 29. In this situation, an RGB combination for the display gradation value is "R=128, G=128, B=32". However, in reality, the response time of the liquid crystal is not zero. Therefore, in a case where the overdrive is not employed, the liquid crystal state level changes, for example, as indicated by bold lines as a reference sign 92 in FIG. 30. In this situation, the RGB combination for the arrival gradation value at the end timing of each of the red field, the green field, and the blue field is, for example, "R=102, G=120, B=65". Thus, in the case where the overdrive is not employed, a desired arrival gradation value is not obtained at the end timing of each field. Note that the liquid crystal state level changes also during the backlight lighting period, and thus, the RGB combination for the display gradation value is, for example, "R=90, G=114, B=81".

In a case where the overdrive is employed, the liquid crystal state level changes, for example, as indicated by bold lines as a reference sign 93 in FIG. 31. In this situation, the RGB combination for the arrival gradation value at the end timing of each of the red field, the green field, and the blue field is "R=128, G=128, B=32". Thus, the liquid crystal makes a response such that the desired arrival gradation value is obtained at the end timing of each field. However, as described above, the liquid crystal state level changes also during the backlight lighting period. As can be understood from FIG. 31, in focusing on the start timing of on state of the backlight, the transmittance is at or higher than a target value in some fields and the transmittance is lower than the target value in the other fields. The RGB combination for the display gradation value is, for example, "R=99, G=128, B=60". Therefore, the color balance is lost and the desired display luminance is not achieved. As described above, even in the case where the overdrive is employed in the field sequential liquid crystal display device, a color shift occurs. Note that hereinafter, a field to be processed is referred to as "an object field".

Here, it is considered that the invention disclosed in WO 2003/098588 applies to a field sequential liquid crystal display device. First, arrival gradation data (data indicating an arrival gradation value) at the start timing of an object field is obtained, based on the input image signal of a previous field (a field immediately before the object field). Then, the drive voltage in the object field is determined, based on the arrival gradation data and the input image signal of the object field. That is, applied gradation data for the object field (data indicating an applied gradation value corresponding to the drive voltage) is obtained, based on the input gradation value of the object field and the arrival gradation value at the end timing of the previous field. However, in a case where such a configuration is employed, flickering or image sticking might occur in displaying a still image. This will be described below.

Here, it is also assumed that the color of an RGB combination "R=128, G=128, B=32" is displayed. Note that a shift of the arrival gradation value to be mentioned below is one example. The shift of the arrival gradation value varies depending on the response characteristic of the liquid crystal and the like.

Assuming that the arrival gradation value at the start timing of a first frame is "16", as a color corresponding to the gradation value "128" is displayed in the red field, the arrival gradation value at the end timing of the red field (start timing of the green field) is "136". Furthermore, as a color corresponding to the gradation value "128" is displayed in the green field, the arrival gradation value at the end timing of the green field (start timing of the blue field) is "127". Moreover, as a color corresponding to the gradation value "32" is displayed in the blue field, the arrival gradation value at the end timing of the blue field (start timing of the red field of a second frame) is "26". Therefore, the arrival gradation value in the first frame shifts "16→136→127→26" (see FIG. 32).

As described above, assuming that the arrival gradation value at the start timing of the second frame is "26", as a color corresponding to the gradation value "128" is displayed in the red field, the arrival gradation value at the end timing of the red field (start timing of the green field) is "134". Furthermore, as a color corresponding to the gradation value "128" is displayed in the green field, the arrival gradation value at the end timing of the green field (start timing of the blue field) is "128". Moreover, as a color corresponding to the gradation value "32" is displayed in the blue field, the arrival gradation value at the end timing of the blue field (start timing of the red field of the third frame) is "16". Therefore, the arrival gradation value in the second frame shifts "26→134→128→16" (see FIG. 33).

Consequently, in the case where the RGB combination of a certain pixel is "R=128, G=128, B=32" in displaying a still image, the arrival gradation value in the pixel repeats the above-described shifts in the first frame and the above-described shifts in the second frame. Thus, the shift of the arrival gradation value changes for each frame depending on the targeted color to be displayed. Moreover, a liquid crystal has a characteristic of deteriorating, when DC voltage is continuously applied. Therefore, AC drive is performed in a liquid crystal display device. Thus, the polarity of the liquid crystal application voltage in each pixel changes for each frame. Therefore, when the shift of the arrival gradation value changes with each frame as described above, flickering in a frame cycle is visually recognized. Furthermore, the arrival gradation value at the start timing of each field is different between a first frame and a second frame, and thus, a writing gradation value in each field is different between the first frame and the second frame. That is, a shift of a writing gradation value in an even-numbered frame and a shift of a writing gradation value in an odd-numbered frame are different. Thus, the liquid crystal application voltage at a writing time of the positive polarity and the liquid crystal application voltage at a writing time of the negative polarity are different from each other, and as a result, a DC component is given to the liquid crystal. This causes image sticking.

Note that, the case in which the invention disclosed in WO 2003/098588 is applied to a field sequential liquid crystal display device has been described. However, a similar phenomenon may also occur, in a case where the above-described invention is applied to a liquid crystal display device of a time division driving system, which is different from the field sequential system (for example, a liquid crystal display device configured to display primary colors by using a plurality of subframes in order to improve display gradations).

Therefore, an object of the present invention is to realize a liquid crystal display device of a time division driving system, capable of preventing an occurrence of a color shift without causing flickering or image sticking.

Solution to Problem

According to a first aspect of the present invention, a liquid crystal display device includes a liquid crystal panel. The liquid crystal display device displays an image by dividing one frame period into a plurality of fields and applying, to the liquid crystal panel, for each field, writing gradation data corresponding to a drive voltage.

The liquid crystal display device includes: a stable arrival gradation data acquisition unit configured to acquire stable arrival gradation data indicating an arrival gradation estimation value at the start timing of each field of the last frame in a case where a virtual display process of three or more frames is performed based on input gradation data for one frame;

an input gradation data compensation unit configured to acquire the writing gradation data by compensating the input gradation data based on the stable arrival gradation data; and a liquid crystal panel drive unit configured to drive the liquid crystal panel based on the writing gradation data.

The stable arrival gradation data acquisition unit is configured to acquire the stable arrival gradation data by repeatedly performing, for each field, an arrival gradation value estimation process for acquiring, based on input gradation data for an object field and an arrival gradation estimation value at the start timing of the object field, an arrival gradation estimation value at the start timing of the next field in a case that a drive voltage for achieving a display luminance corresponding to the input gradation data is applied to the liquid crystal panel in an object field.

In a case where an arrival gradation value at the start timing of each of the plurality of fields serves as an arrival gradation estimation value indicated by the stable arrival gradation data, the input gradation data compensation unit is configured to acquire the writing gradation data to achieve the display luminance corresponding to the input gradation data in the plurality of fields.

According to a second aspect of the present invention, in the first aspect of the present invention, the stable arrival gradation data acquisition unit includes a plurality of arrival gradation value estimation circuits configured to perform the arrival gradation value estimation process.

Each of the plurality of arrival gradation value estimation circuits includes:

an application gradation data acquisition circuit and a field arrival gradation data acquisition circuit.

The application gradation data acquisition circuit receives first input data and second input data. In a case where an arrival gradation value at the start timing of an object field serves as an arrival gradation estimation value indicated by the second input data, the application gradation data acquisition circuit acquires application gradation data corresponding to a drive voltage for achieving display luminance corresponding to the first input data in the object field.

The field arrival gradation data acquisition circuit receives the second input data and the application gradation data. In a case where an arrival gradation value at the start timing of the object field serves as an arrival gradation estimation value indicated by the second input data, the field arrival gradation data acquisition circuit obtains field arrival gradation data indicating an arrival gradation estimation value at the start timing of the next field in a case where a drive voltage corresponding to the application gradation data is applied to the liquid crystal panel.

Input gradation data for an object field is given, as the first input data, to each of the arrival gradation value estimation circuits.

In a case where two arrival gradation value estimation circuits provided to correspond to two consecutive fields for a virtual display process are defined as the preceding arrival gradation value estimation circuit and a succeeding arrival gradation value estimation circuit, field arrival gradation data obtained by a field arrival gradation data acquisition circuit included in the preceding arrival gradation value estimation circuit is given, as the second input data, to the succeeding arrival gradation value estimation circuit.

According to a third aspect of the present invention, in the second aspect of the present invention, the input gradation data compensation unit includes at least one application gradation data acquisition circuit equal in number to the number of fields constituting the one frame period.

Input gradation data for an object field is given, as the first input data, and stable arrival gradation data for the object field is given, as the second input data, to the application gradation data acquisition circuit included in the input gradation data compensation unit.

The application gradation data is output, as the writing gradation data, from the application gradation data acquisition circuit included in the input gradation data compensation unit.

According to a fourth aspect of the present invention, in the second aspect of the present invention, the stable arrival gradation data acquisition unit further includes at least one connection switching circuit in accordance with the number of frames, for each of which a virtual display process is performed, the at least one connection switching circuit being configured to control a connection between the plurality of arrival gradation value estimation circuits in accordance with a field number signal indicating the number of fields constituting the one frame period.

Each of the connection switching circuits is configured to control the connection between the plurality of arrival gradation value estimation circuits to give field arrival gradation data, as the second input data, to an arrival gradation value estimation circuit, the field arrival gradation data being acquired by the field arrival gradation data acquisition circuit included in an arrival gradation value estimation circuit, in accordance with the field number signal, of a plurality of arrival gradation value estimation circuits provided to correspond to the plurality of fields in the preceding frame for a virtual display process, the arrival gradation value estimation circuit being provided to correspond to a first field of the succeeding frame for the virtual display process.

According to a fifth aspect of the present invention, in the first aspect of the present invention, the liquid crystal display device further includes a field assignment unit configured to assign the input gradation data to the plurality of fields based on a display sequence of colors in a frame.

In acquiring the stable arrival gradation data, the stable arrival gradation data acquisition unit is configured to perform a virtual display process based on sequential data serving as data acquired from the field assignment unit assigning the input gradation data to the plurality of fields.

According to a sixth aspect of the present invention, in the first aspect of the present invention, the one frame period is divided into a plurality of fields to display a color screen different for each of the plurality of fields.

According to a seventh aspect of the present invention, in the sixth aspect of the present invention, the one frame period is divided into three fields including a red field configured to display a red screen, a green field configured to display a green screen, and a blue field configured to display a blue screen.

According to an eighth aspect of the present invention, in the sixth aspect of the present invention, one frame period includes a field configured to display a mixed color screen.

According to a ninth aspect of the present invention, in the eighth aspect of the present invention, the one frame period is divided into four fields including a red field configured to display a red screen, a green field configured to display a green screen, a blue field configured to display a blue screen, and a white field configured to display a white screen.

According to a tenth aspect of the present invention, in the first aspect of the present invention, input gradation data for one color is divided into a plurality field data, and a plurality of drive voltages corresponding to the plurality of field data are respectively applied to the liquid crystal panel in the plurality of fields, for display based on the input gradation data for the one color.

According to an eleventh aspect of the present invention, in the first aspect of the present invention, the liquid crystal panel includes:

a pixel electrode to be disposed in a matrix;

a common electrode disposed to face the pixel electrode;

a liquid crystal interposed between the pixel electrode and the common electrode;

a scanning signal line;

a video signal line to be applied with a video signal in accordance with the writing gradation data; and a thin film transistor.

A control terminal for connecting to the scanning signal line, a first conduction terminal for connecting to the video signal line, and a second conduction terminal for connecting to the pixel electrode, and a channel layer formed with an oxide semiconductor are provided.

According to a twelfth aspect of the present invention, in the eleventh aspect of the present invention, the oxide semiconductor mainly includes indium, gallium, zinc, and oxygen.

According to a thirteenth aspect of the present invention, a driving method for a liquid crystal display device is configured to display an image by dividing one frame period into a plurality of fields and applying, to a liquid crystal panel, for each field, writing gradation data corresponding to a drive voltage.

The driving method includes: a stable arrival gradation data acquisition step of acquiring stable arrival gradation data indicating an arrival gradation estimation value at the start timing of each field of the last frame in a case where a virtual display process of three or more frames is performed based on input gradation data for one frame;

an input gradation data compensation step of acquiring the writing gradation data by compensating the input gradation data based on the stable arrival gradation data; and a liquid crystal panel drive step of driving the liquid crystal panel based on the writing gradation data.

In the stable arrival gradation data acquisition step, the stable arrival gradation data is acquired by repeatedly performing, for each field, an arrival gradation value estimation process for acquiring, based on input gradation data for an object field and an arrival gradation estimation value at the start timing of the object field, an arrival gradation estimation value at the start timing of the next field in a case where a drive voltage for achieving a display luminance corresponding to input gradation data is applied to the liquid crystal panel in the object field, and in the input gradation data compensation step, the writing gradation data is acquired to achieve the display luminance corresponding to the input gradation data in the plurality of fields, in a case where an arrival gradation value at the start timing of each of the plurality of fields serves as an arrival gradation estimation value indicated by the stable arrival gradation data.

Advantageous Effects of Invention

According to the first aspect of the present invention, in the stable arrival gradation data acquisition unit, an arrival gradation estimation value at the start timing of each field of the last frame is acquired, when it is assumed that a display process of three or more frames is performed based on input gradation data for one frame. Furthermore, in the input gradation data compensation unit, writing gradation data is acquired by compensating the input gradation data based on the arrival gradation estimation value acquired by the stable arrival gradation data acquisition unit for each field. Then, the liquid crystal is driven by using the writing gradation data that has been obtained, as described above. As described above, a compensation is performed in each field to enhance a temporal change in the input gradation data between two consecutive fields, in consideration of the liquid crystal state at the start timing of the field. Accordingly, even when the liquid crystal state changes while the backlight is lighting, an occurrence of a color shift is prevented and a desired display luminance is achieved in each field. Furthermore, an arrival gradation estimation value, which is the data that has been obtained in a virtual display process for three or more frames, is used for obtaining writing gradation data corresponding to an actual drive voltage, and thus, a color displayed at each pixel when a still image is displayed is converged into a certain color. This prevents a shift of the liquid crystal state (a shift of the arrival gradation value) from changing in each frame. As a result, an occurrence of flickering is prevented. Furthermore, a difference between the liquid crystal application voltage at a writing time in the positive polarity and the liquid crystal application voltage at a writing time in the negative polarity is substantially reduced. As a result, an occurrence of image sticking is prevented. Therefore, a liquid crystal display device of a time division driving system capable of preventing an occurrence of a color shift is achieved without causing flickering or image sticking.

According to the second aspect of the present invention, a similar effect to the first aspect of the present invention is achieved.

According to the third aspect of the present invention, a similar effect to the first aspect of the present invention is achieved.

According to the fourth aspect of the present invention, an occurrence of a color shift is prevented without causing flickering or image sticking, while effectively preventing an occurrence of a color breakup, by switching the number of fields constituting one frame period in accordance with a displayed image.

According to the fifth aspect of the present invention, without increasing the circuit scale, a liquid crystal display device capable of achieving a similar effect to the first aspect of the present invention is achieved, regardless of a display sequence of the primary colors in the frame.

According to the sixth aspect of the present invention, an occurrence of a color shift is prevented without causing flickering or image sticking in a liquid crystal display device that employs a field sequential system as a time division driving system.

According to the seventh aspect of the present invention, a similar effect to the sixth aspect of the present invention is achieved.

According to the eighth aspect of the present invention, a liquid crystal display device of a time division driving system capable of preventing an occurrence of a color shift and a color breakup is achieved without causing flickering or image sticking.

According to the ninth aspect of the present invention, an occurrence of color breakup is effectively prevented.

According to the tenth aspect of the present invention, an occurrence of a color shift is prevented without causing flickering or image sticking in a liquid crystal display device that employs, as a time division driving system, a system for displaying the primary colors by using a plurality of fields (subframes) to improve display gradations.

According to the eleventh aspect of the present invention, a thin film transistor with a channel layer including an oxide semiconductor is used as the thin film transistor provided in the liquid crystal panel. Thus, effects of high fineness and low power consumption are achieved, and in addition, the writing speed is increased as compared to the known art. Therefore, an occurrence of a color shift is prevented more effectively.

According to the twelfth aspect of the present invention, a similar effect to the eleventh aspect of the present invention is achieved with certainty, by using indium gallium zinc oxide for the oxide semiconductor forming the channel layer.

According to the thirteenth aspect of the present invention, a similar effect to the first aspect of the present invention is achieved, in the driving method for the liquid crystal display device.

BRIEF DESCRIPTION OF DRAWINGS

FIG. 4 is a table illustrating one example of a gradation luminance table of red color.

FIG. 8 is a table for illustrating a lookup table for acquiring application gradation value.

FIG. 9 is a table for illustrating a lookup table for application gradation value acquisition.

DESCRIPTION OF EMBODIMENTS

0. Introduction

Figure 1:
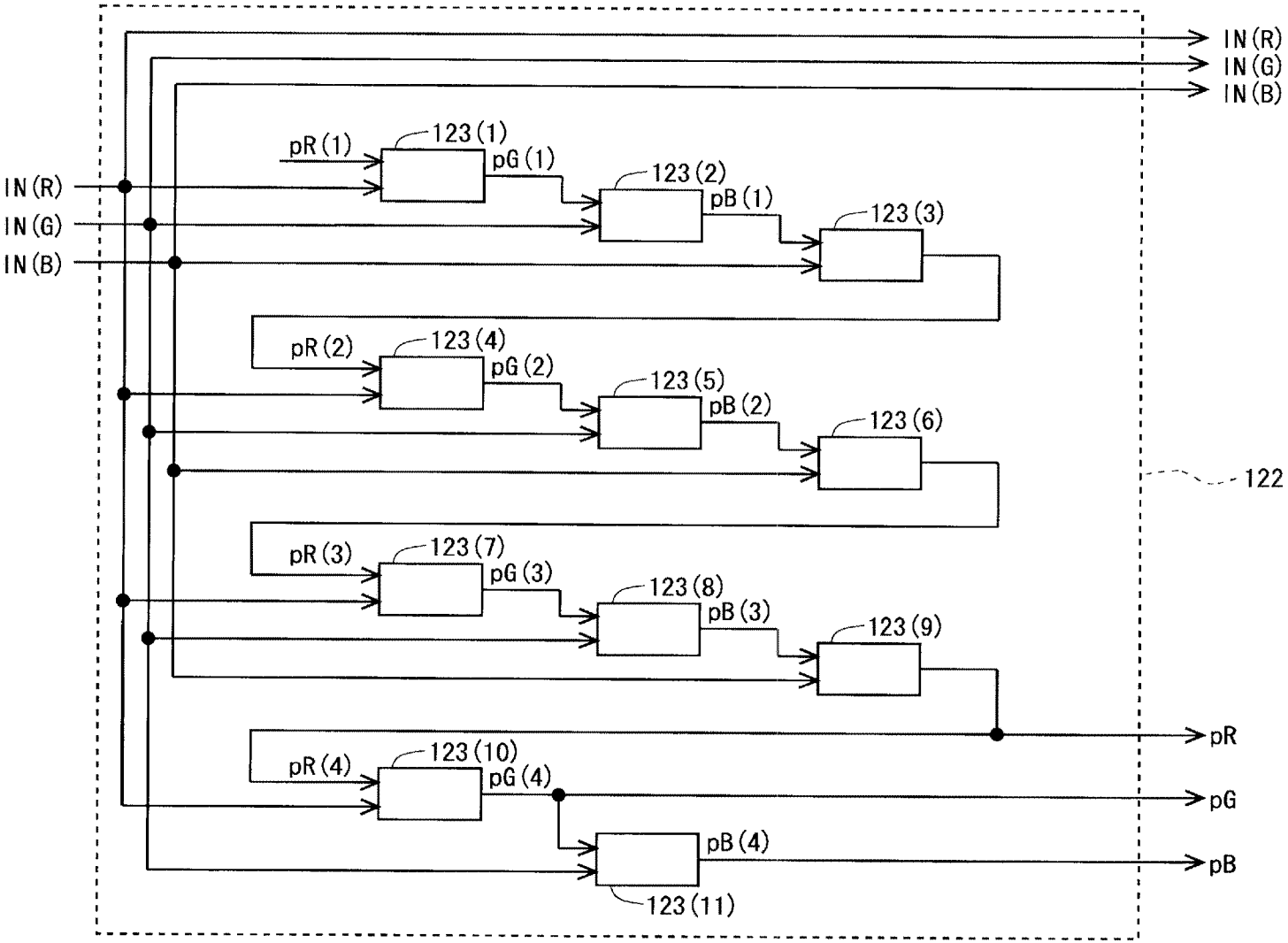
FIG. 1 is a block diagram illustrating a detailed configuration of a stable arrival gradation data acquisition unit in a liquid crystal display device in a first embodiment of the present invention.

Before describing embodiments, an overview of the present invention will be described with reference to FIG. 2 to FIG. 10. Note that a liquid crystal display device capable of performing a gradation display having 256 gradations is illustrated as an example in the description herein and in the description of first to fourth embodiments, and a liquid crystal display device capable of performing a gradation display having 768 gradations is illustrated as an example in the description of the fifth embodiment.

0.1 Concept in the Present Invention

As described above, the overdrive is performed in a liquid crystal display device employing a time division driving system, and then flickering or image sticking might occur in displaying a still image, due to the shift of the arrival gradation value that changes for each frame. To prevent the shift of the arrival gradation value from changing for each frame, an application gradation value in each field is needed not to change between frames. Therefore, a compensation from an input gradation value to an application gradation value is performed for each frame in the present invention, instead of each field. Specifically, in a case where one frame period includes three fields, in displaying a certain still image, regardless of the arrival gradation value at the start timing of the display, a liquid crystal is driven using one certain combination as a combination of the application gradation values of the three fields. For example, in a case where an RGB combination of the input gradation values for a certain pixel in a certain still image includes "R=128, G=128, B=32", the liquid crystal is driven by using data of one RGB combination of, for example, "R=149, G=122, B=4" for the pixel. Thus, for all combinations of input gradation values of a plurality of fields constituting one frame period (in the example above, the combination of the R, G, B input gradation values), a combination of each set of application gradation values is used to drive the liquid crystal.

Thus, in a liquid crystal display device in the present invention, as an overview, a process including the following two steps (a first step and a second step) are performed to acquire a combination of the application gradation values from a combination of the input gradation values. In the first step, an arrival gradation estimation value is acquired at the start timing of each field of the last frame, in a case where it is assumed that a display process for three or more frames has been performed based on a combination of input gradation values for one frame. In the second step, an application gradation value for a display corresponding to an input gradation value is acquired for each field, based on the input gradation value and the arrival gradation estimation value acquired in the first step. Then, for a period while a certain still image is being displayed, the liquid crystal is driven by using the application gradation value acquired in the second step.

Figure 2:
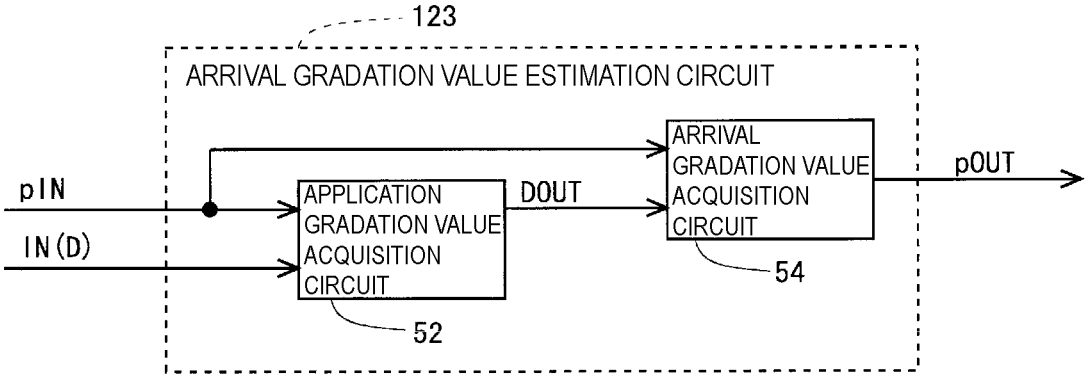
FIG. 2 is a block diagram illustrating a configuration of an arrival gradation value estimation circuit provided in a liquid crystal display device in the present invention.

An arrival gradation value estimation circuit 123 having a configuration as illustrated in FIG. 2 is provided in the liquid crystal display device, to perform the process in the first step. In such an arrival gradation value estimation circuit 123, an arrival gradation estimation value at the end timing of an object field is acquired based on an input gradation value of the object field (a field for which the arrival gradation estimation value is acquired) and an arrival gradation estimation value at the start timing of the object field (arrival gradation estimation value at the end timing of the previous field). Note that a process performed in one arrival gradation value estimation circuit 123 corresponds to an arrival gradation value estimation process.

For example, in a case where one frame period includes first to third fields, an arrival gradation estimation value at the end timing of the first field is first acquired by the arrival gradation value estimation circuit 123. In this situation, an appropriately set gradation value (for example, a gradation value "128", to which the liquid crystal easily responds) is used for an arrival gradation estimation value at the start timing of the first field. Next, an arrival gradation estimation value at the end timing of the second field is acquired based on the arrival gradation estimation value acquired most recently and an input gradation value of the second field. Furthermore, an arrival gradation estimation value at the end timing of the third field is acquired based on the arrival gradation estimation value acquired most recently and an input gradation value of the third field. In this manner, an arrival gradation estimation value at the end timing of the third field after performing a virtual display process for one frame (that is, an arrival gradation estimation value at the start timing of the first field, in performing a virtual display process of the second frame) is acquired. By repeating the above process, an arrival gradation estimation value is acquired at the start timing of each field of the last frame, in performing a virtual display process of three or more frames based on an input gradation value for one frame.

As illustrated in FIG. 2, the arrival gradation value estimation circuit 123 includes an application gradation value acquisition circuit 52 and an arrival gradation value acquisition circuit 54. Note that in FIG. 2, input gradation data of the object field is expressed by a reference sign IN (D), arrival gradation data indicating an arrival gradation estimation value at the start timing of the object field is expressed by a reference sign pIN, and arrival gradation data indicating an arrival gradation estimation value at the end timing of the object field is expressed by a reference sign pOUT.

The application gradation value acquisition circuit 52 acquires application gradation data DOUT for the object field, based on input gradation data IN (D) and arrival gradation data pIN. That is, the application gradation value acquisition circuit 52 acquires an application gradation value, which is needed for achieving a display corresponding to an input gradation value in a subsequent field, in a state where the liquid crystal stat corresponds to a certain arrival gradation value. In order to realize this, the application gradation value acquisition circuit 52 includes a conversion table for storing "a value associated with an input gradation value of the object field", "a value associated with the arrival gradation value at the start timing of the object field", and "an application gradation value corresponding to a combination of these values". Here, such "a value associated with the input gradation value of the object field" is an input gradation value that can be taken in the liquid crystal display device, and the "value associated with the arrival gradation value at the start timing of the object field" is an arrival gradation value that can be taken in the liquid crystal display device. Note that, a process using an arithmetic expression for performing a similar conversion may be performed, instead of using the conversion table. An example of a way of acquiring an application gradation value to be stored in the conversion table will be described below. Note that, here, it is assumed that one frame period includes three fields: a red field, a green field, and a blue field.

Figure 3:
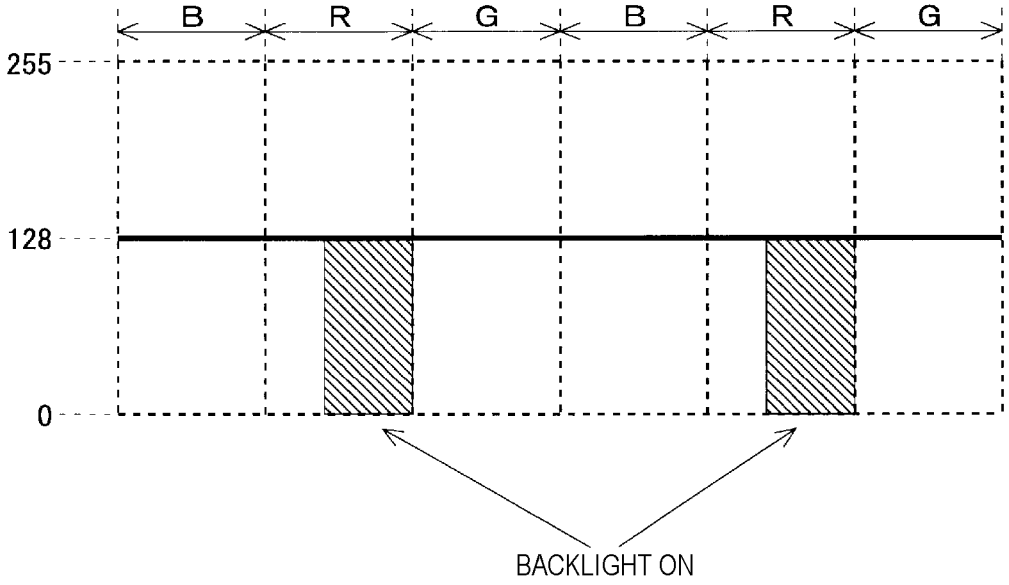
FIG. 3 is a diagram for describing a way of calculating an application gradation value.

First, a luminance value corresponding to each gradation value (an input gradation value) is measured for each color. For example, as illustrated in FIG. 3, for measuring a luminance value corresponding to the gradation value "128" of the red color, the application gradation values in all fields are set to "128" and the backlight is switched on only in the red fields. The luminance value at this time is measured, for example, by a luminance meter. By setting the same application gradation value for all fields as described above, a luminance value corresponding to each gradation value in each color when there is no change in the liquid crystal state is acquired. As a result, "a gradation luminance table" serving as a table associating a gradation value with a luminance value for each color is created. FIG. 4 illustrates one example of a gradation luminance table for red. It can be understood from FIG. 4 that "a luminance value corresponding to a gradation value "253" of red is "73.133" (candela per square meter)". Note that, hereinafter, when referring to a luminance value, the unit is omitted.

Figure 5:
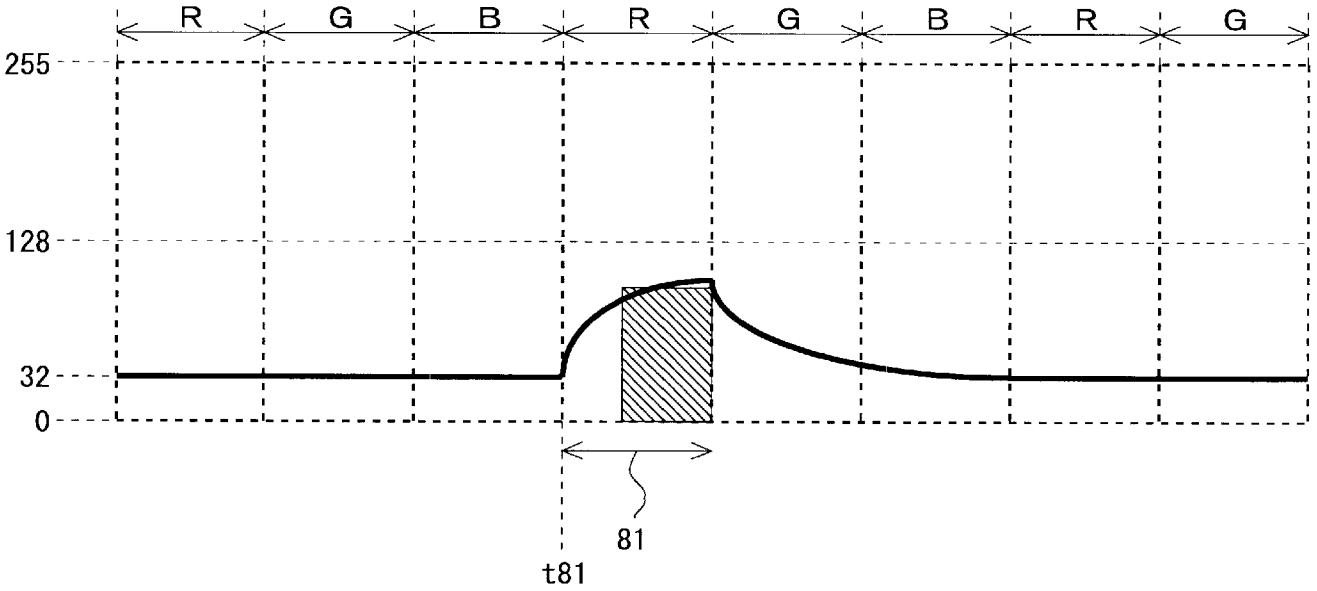
FIG. 5 is a diagram for illustrating a way of acquiring an application gradation value.

Next, a luminance value is measured when the application gradation value is changed in a certain field and the backlight is switched on only in a certain field. For example, as illustrated in FIG. 5, from a state in which the arrival gradation value is maintained at "32", the application gradation value is changed to "128" in a field (a red field) indicated by a reference sign 81 and the backlight is switched on only in the field. At this time, in a case where the field indicated by the reference sign 81 is regarded as the object field, "an arrival gradation value at a time point t81" corresponds to "an arrival gradation value at the start timing of the object field". In the example illustrated in FIG. 5, according to a result of a measurement performed as described above and the above-mentioned gradation luminance table, "an input gradation value of the object field" is acquired so that the application gradation value is to be "128", when the arrival gradation value at the start timing of the object field is "32". For example, in a case where the luminance value of the field indicated by the reference sign 81 in FIG. 5 becomes "30.0" and the luminance value corresponding to a gradation value "100" in the gradation luminance table for red (see FIG. 4) becomes "30.0", the application gradation value can be set to "128", when "the arrival gradation value at the start timing of the object field is '32' and the input gradation value of the object field is '100'".

Figures 6, 7:
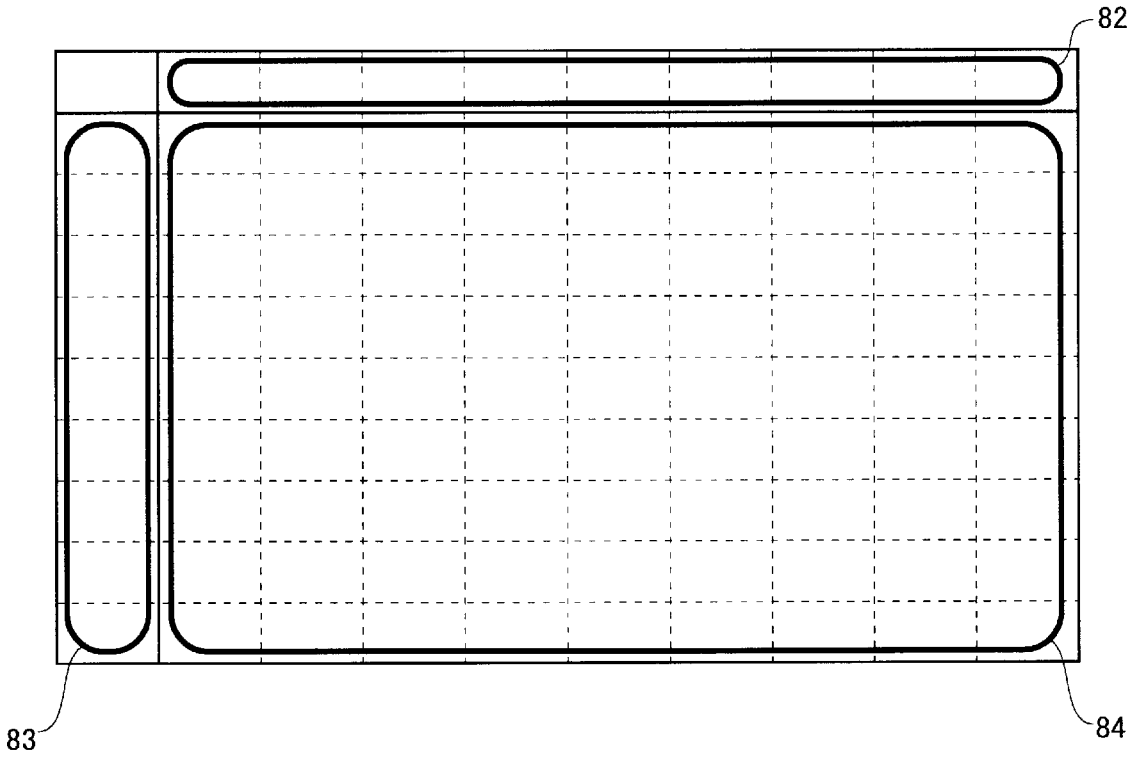
FIG. 6 is a table for illustrating a lookup table for acquiring application gradation value.
FIG. 7 is a table for illustrating a lookup table for acquiring application gradation value.

As described above, for each color, an application gradation value corresponding to a combination of each input gradation value of the object field, and each arrival gradation value at the start timing of the object field are acquired. Accordingly, a conversion table as illustrated in FIG. 6 (hereinafter referred to as "a lookup table for acquiring application gradation value") can be created. As illustrated in FIG. 7, the lookup table for acquiring application gradation value includes: a region 82 for storing values associated with an arrival gradation value at a start timing of an object field; a region 83 for storing values associated with an input gradation value of the object field; and a region 84 for storing application gradation values corresponding to a combination of the arrival gradation value at the start timing of the object field and the input gradation value of the object field. For example, as illustrated in FIG. 8, values of an every "32" are stored in the region 82 and the region 83. In the region 84, application gradation values acquired as described above are stored.

As described above, in the example illustrated in FIG. 8, every "32" values are stored, as values associated with the arrival gradation value at the start timing of the object field and values associated with the input gradation value of the object field are stored in the lookup table for acquiring application gradation value. However, in a case where an increase in memory capacity is permitted, every "1" values may be stored in the region 82 in FIG. 7 and the region 83 in FIG. 7. Furthermore, like the example illustrated in FIG. 8, in a case where values of every plurality of values are stored, as the values associated with the arrival gradation value at the start timing of the object field and the values associated with the input gradation value of the object field, "an application gradation value of the object field", corresponding to a value that is not stored in the region 82 or a value that is not stored in the region 83, may be acquired by, for example, a linear interpolation process.

Next, the arrival gradation value acquisition circuit 54 (see FIG. 2) will be described. The arrival gradation value acquisition circuit 54 acquires arrival gradation data pOUT, based on the arrival gradation data pIN and the application gradation data DOUT. In order to realize this, a conversion table for storing a "value associated with the arrival gradation value at the start timing of the object field", a "value associated with the application gradation value of the object field", and an "arrival gradation value corresponding to a combination of these values" (hereinafter, referred to as "lookup table for arrival gradation value acquisition"), is provided in the arrival gradation value acquisition circuit 54.

Note that, a process may be performed by using an arithmetic expression for performing a similar conversion, instead of using the conversion table.

The arrival gradation value acquiring lookup table can be created, for example, as follows. First, in a state in which an arrival gradation value is set to a certain value and a certain arrival gradation value is given, an arrival gradation value one field after such a certain application gradation value is measured by a photodiode or the like. Such a measurement is performed for each application gradation value (for example, "0" to "255") that can be taken in the liquid crystal display device to be used. The above measurement is performed for each arrival gradation value (arrival gradation value at a measurement start timing) (for example, "0" to "255") that can be taken in the liquid crystal display device to be used. Accordingly, the arrival gradation value acquiring lookup table as illustrated in FIG. 9 is created.

By providing the above-mentioned arrival gradation value estimation circuit 123 including the application gradation value acquisition circuit 52 and the arrival gradation value acquisition circuit 54, the process in the first step is achieved.

Figure 10:
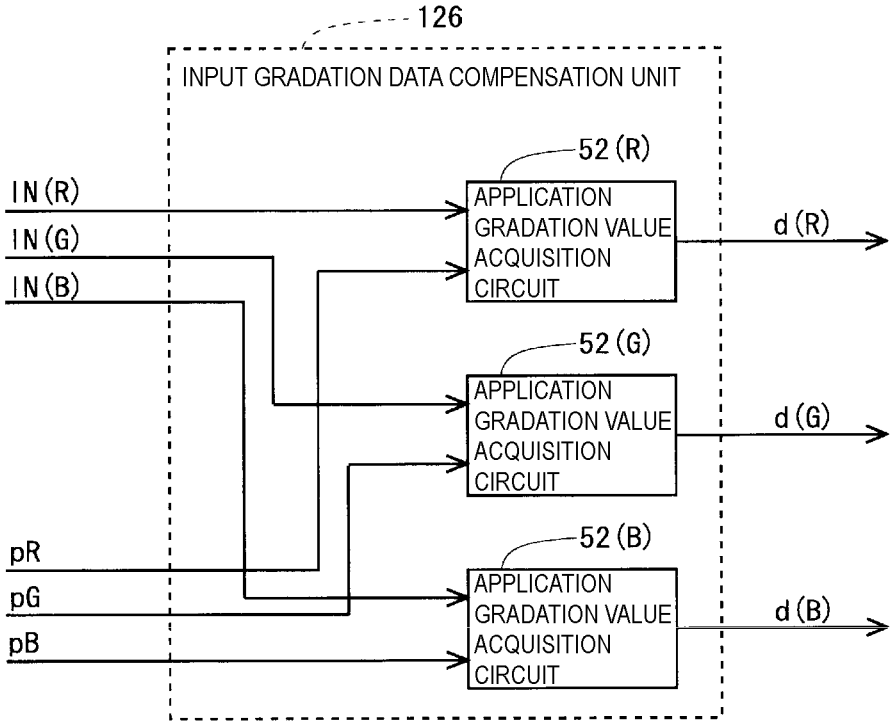
FIG. 10 is a block diagram illustrating a configuration of an input gradation data compensation unit provided in a liquid crystal display device in the present invention.

An input gradation data compensation unit 126 having a configuration as illustrated in FIG. 10, for example, is provided in the liquid crystal display device, in order to perform a process in the second step. Note that, the configuration illustrated in FIG. 10 is provided for a case where one frame period includes three fields: a red field, a green field, and a blue field. Such an input gradation data compensation unit 126 acquires for each field, an application gradation value corresponding to an actual drive voltage, based on the input gradation value and the arrival gradation estimation value acquired in the first step.

The input gradation data compensation unit 126 includes application gradation value acquisition circuits corresponding to the respective fields. The application gradation value acquisition circuit in the input gradation data compensation unit 126 has a similar internal configuration to the configuration of the application gradation value acquisition circuit 52 in the arrival gradation value estimation circuit 123 (see FIG. 2). Note that, in FIG. 10, an application gradation value acquisition circuit for the red field is given with a reference sign 52 (R), an application gradation value acquisition circuit for the green field is given with a reference sign 52 (G), and an application gradation value acquisition circuit for the blue field is given with a reference sign 52 (B). The provision of such an input gradation data compensation unit 126 including an application gradation value acquisition circuit corresponding to each field enables the process in the second step.

In the liquid crystal display device in the present invention, an application gradation value acquired by a process including two steps (the first step and the second step) as described above is used to drive a liquid crystal. When a display process for three or more frames is performed according to an input gradation value for one frame, as described above, the arrival gradation values of each field are converged and the application gradation values of each field are also converged. In this regard, the liquid crystal may vibrate with a cycle of two frame periods or with a cycle of three frame periods. However, a difference between the frames becomes minimized. Therefore, by driving the liquid crystal by using one of a combination of vibrating values (a combination of three values when one frame period includes three fields), a display is converged to a color of a certain combination. In this manner, even when the overdrive is performed, an occurrence of flickering or image sticking is prevented.

Embodiments of the present invention will be described below with reference to the accompanying drawings.

1. First Embodiment

1.1 Overall Configuration and Operation Overview

Figure 11:
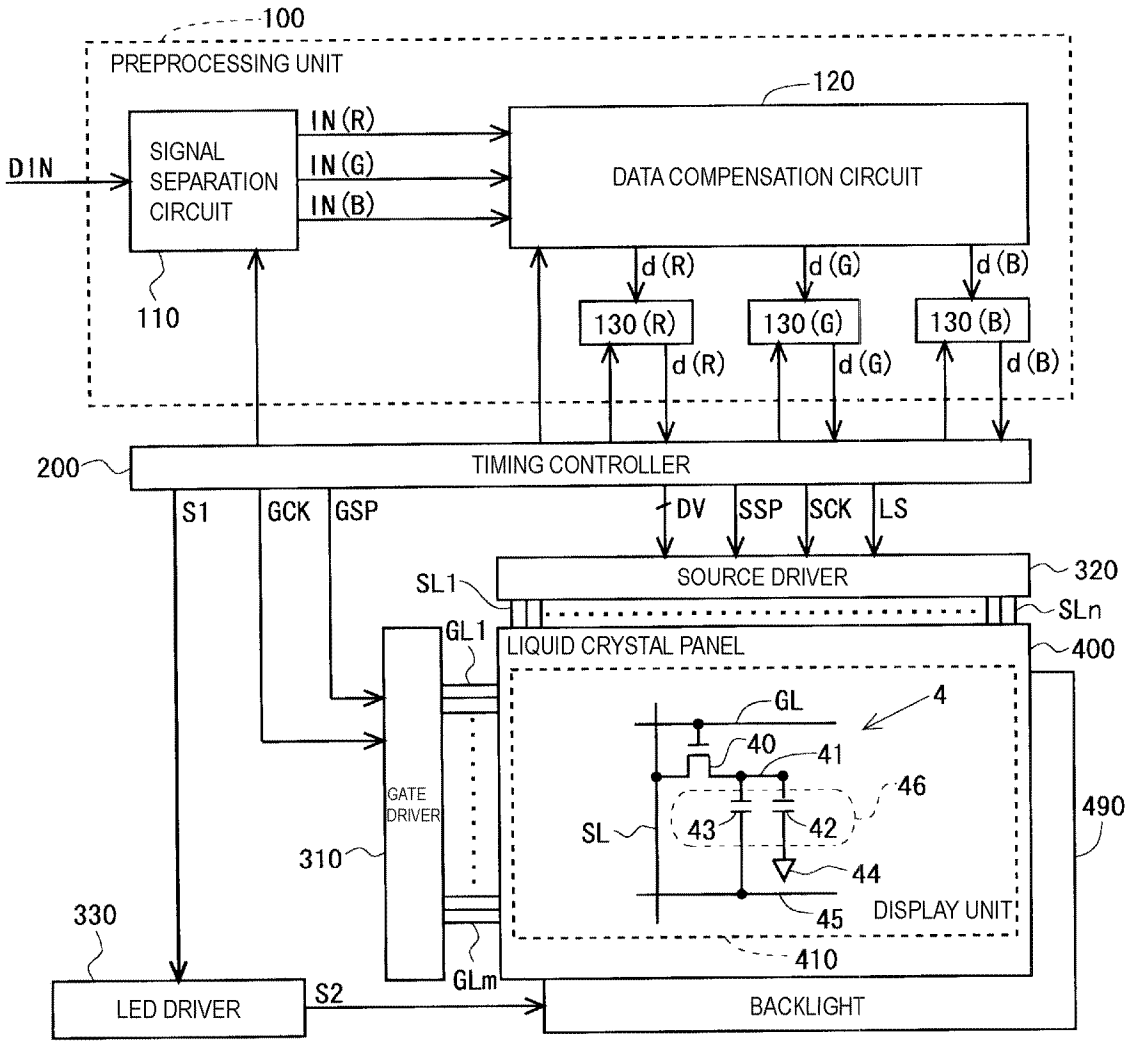
FIG. 11 is a block diagram illustrating an overall configuration of the liquid crystal display device in the first embodiment of the present invention.

FIG. 11 is a block diagram illustrating an overall configuration of the liquid crystal display device in the first embodiment of the present invention. This liquid crystal display device includes a preprocessing unit 100, a timing controller 200, a gate driver 310, a source driver 320, an LED driver 330, a liquid crystal panel 400, and a backlight 490. Note that either or both of the gate driver 310 and the source driver 320 may be provided in the liquid crystal panel 400. A display unit 410 for displaying an image is included in the liquid crystal panel 400. A signal separation circuit 110, a data compensation circuit 120, a red field memory 130 (R), a green field memory 130 (G), and a blue field memory 130 (B) are included in the preprocessing unit 100. In the present embodiment, a Light-Emitting Diode (LED) is employed for a light source of the backlight 490. Specifically, the backlight 490 includes a red LED, a green LED, and a blue LED. Note that, in the present embodiment, the liquid crystal panel drive unit is enabled by the timing controller 200, the gate driver 310, and the source driver 320.

Figure 12:
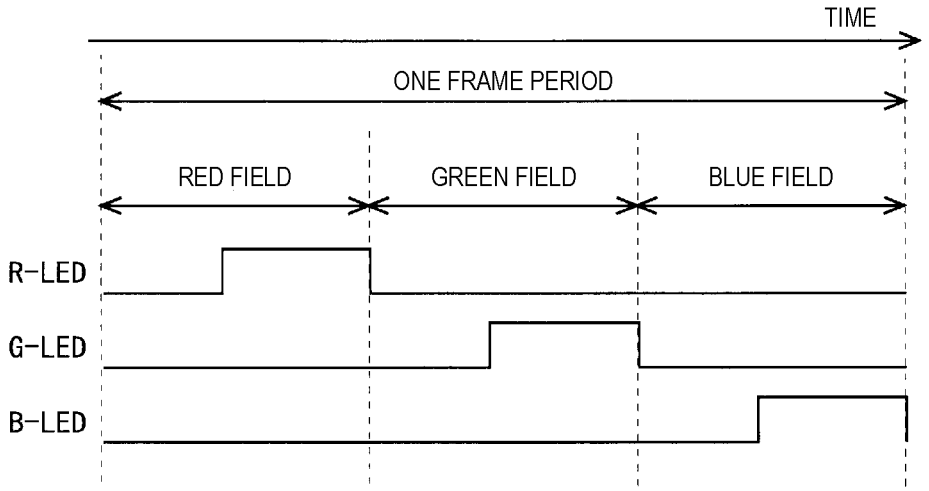
FIG. 12 is a diagram illustrating a configuration of one frame period in the first embodiment.

The liquid crystal display device in the present embodiment employs a field sequential system. FIG. 12 is a diagram illustrating a configuration of one frame period in the present embodiment. Such one frame period is divided into a red field for displaying a red screen based on a red component of an input image signal DIN, a green field for displaying a green screen based on a green component of the input image signal DIN, and a blue field for displaying a blue screen based on a blue component of the input image signal DIN. In the red field, the red LED is in on state after a predetermined period has elapsed from the start timing of the field. In the green field, the green LED is in on state after a predetermined period has elapsed from the start timing of the field. In the blue field, the blue LED is in on state after a predetermined period has elapsed from the start timing of the field. During the operation of the liquid crystal display device, the red field, the green field, and the blue field are repeated. Thereby, a red screen, a green screen, and a blue screen are repeatedly displayed, and a desired color image is displayed on the display unit 410. Note that a sequence of the fields is not particularly limited. The sequence of the fields may be, for example, a sequence of "a blue field, a green field, and a red field". Furthermore, the length of a period in which the LED is in on state in each field can be determined in consideration of a response characteristic of the liquid crystal.

Regarding FIG. 11, a plurality (n) of source bus lines (video signal lines) SL1 to SLn and a plurality (m) of gate bus lines (scanning signal lines) GL1 to GLm are arranged in the display unit 410. A pixel formation unit 4 configured to form a pixel is provided to correspond to each intersection of the source bus lines SL to SLn and the gate bus lines GL1 to GLm. That is, a plurality (n×m) of pixel formation units 4 are included in the display unit 410. The plurality of pixel formation units 4 are arranged in a matrix and configure a pixel matrix of m rows×n columns. Each of the pixel formation units 4 includes: a Thin Film Transistor (TFT) 40 as a switching element for connecting, to a gate terminal, a gate bus line GL passing a corresponding intersection and for connecting, to a source terminal, a source bus line SL passing the intersection; a pixel electrode 41 to be connected to a drain terminal of the TFT 40; a common electrode 44 and an auxiliary capacity electrode 45 provided for common use of the plurality of pixel formation units 4; a liquid crystal capacity 42 formed with the pixel electrode 41 and the common electrode 44; and an auxiliary capacity 43 formed by the pixel electrode 41 and the auxiliary capacity electrode 45. A pixel capacity 46 includes the liquid crystal capacity 42 and the auxiliary capacity 43. Note that, in the display unit 410 in FIG. 11, only a constitution element corresponding to one pixel formation unit 4 is illustrated.

Note that, for example, an oxide TFT (a thin film transistor using an oxide semiconductor for a channel layer) can be employed for the TFT 40 in the display unit 410. More specifically, a TFT, in which the channel layer is formed by In—Ga—Zn—O (indium gallium zinc oxide) that is an oxide semiconductor with indium (In), gallium (Ga), zinc (Zn), and oxygen (O) as main components (hereinafter, referred to as "In—Ga—Zn—O-TFT"), can be employed for the TFT 40. By employing such In—Ga—Zn—O-TFT, effects of high fineness and low power consumption are achieved, and in addition, the writing speed is increased as compared to the related art. A transistor, in which an oxide semiconductor different from In—Ga—Zn—O (indium gallium zinc oxide) is used for the channel layer, can be employed. For example, a similar effect is achieved, in a case where a transistor, in which an oxide semiconductor including at least one of indium, gallium, zinc, copper (Cu), silicon (Si), tin (Sn), aluminum (Al), calcium (Ca), germanium (Ge), and lead (Pb), is used for the channel layer. Note that the present invention does not exclude use of any TFT other than the oxide TFT.

Next, operations of constitution elements illustrated in FIG. 11 will be described. The signal separation circuit 110 in the preprocessing unit 100 separates an input image signal DIN supplied from the outside into red input gradation data IN (R), green input gradation data IN (G), and blue input gradation data IN (B).

The data compensation circuit 120 in the preprocessing unit 100 compensates the input gradation data (red input gradation data IN (R), green input gradation data IN (G), and blue input gradation data IN (B)) output from the signal separation circuit 110 into data associated with a voltage (a drive voltage) applied to the liquid crystal panel 400, and outputs the compensated data as writing gradation data. The writing gradation data output from the data compensation circuit 120 includes writing gradation data d (R) for a red field, writing gradation data d (G) for a green field, and writing gradation data d (B) for a blue field. Note that the data compensation circuit 120 will be described later in detail.

In the red field memory 130 (R), the green field memory 130 (G), and the blue field memory 130 (B), the writing gradation data d (R) for the red field, the writing gradation data d (G) for the green field, and the writing gradation data d (B) for the blue field output from the data compensation circuit 120 are respectively stored.

The timing controller 200 retrieves the writing gradation data d (R) for the red field, the writing gradation data d (G) for the green field, and the writing gradation data d (B) for the blue field, respectively, from the red field memory 130 (R) the green field memory 130 (G), and the blue field memory 130 (B), and outputs a digital video signal DV, a gate start pulse signal GSP, and a gate clock signal GCK for controlling an operation of the gate driver 310, a source start pulse signal SSP, a source clock signal SCK, and a latch strobe signal LS for controlling an operation of the source driver 320, and an LED driver control signal S1 for controlling an operation of the LED driver 330.

The gate driver 310 repeats application of an active scanning signal to each gate bus line GL with a cycle of one vertical scanning period, based on the gate start pulse signal GSP and the gate clock signal GCK supplied from the timing controller 200.

The source driver 320 receives the digital video signal DV, the source start pulse signal SSP, the source clock signal SCK, and the latch strobe signal LS, which are supplied from the timing controller 200, and applies a driving video signal to each source bus line SL. In this situation, at a timing when a pulse of the source clock signal SCK is generated, the digital video signal DV indicating a voltage to be applied to each source bus line SL is sequentially held in the source driver 320. Then, at a timing when a pulse of the latch strobe signal LS is generated, the digital video signal DV, which is held, is converted into an analog voltage. Such a converted analog voltage as the driving video signal is applied simultaneously to all source bus lines SL1 to SLn.

The LED driver 330 outputs a light source control signal S2 for controlling a state of each LED included in the backlight 490, based on the LED driver control signal S1 supplied from the timing controller 200. In the backlight 490, switching of the state of each LED (switching between on state and off state) is performed based on the light source control signal S2, as appropriate. Note that in the present embodiment, the states of the respective LEDs are switched as illustrated in FIG. 12.

By applying the scanning signal to the gate bus lines GL1 to GLm, applying the driving video signal to the source bus lines SL1 to SLn, and switching the states of the respective LEDs as appropriate, as described above, an image corresponding to the input image signal DIN is displayed on the display unit 410 of the liquid crystal panel 400.

1.2 Data Compensation Circuit

Figure 13:
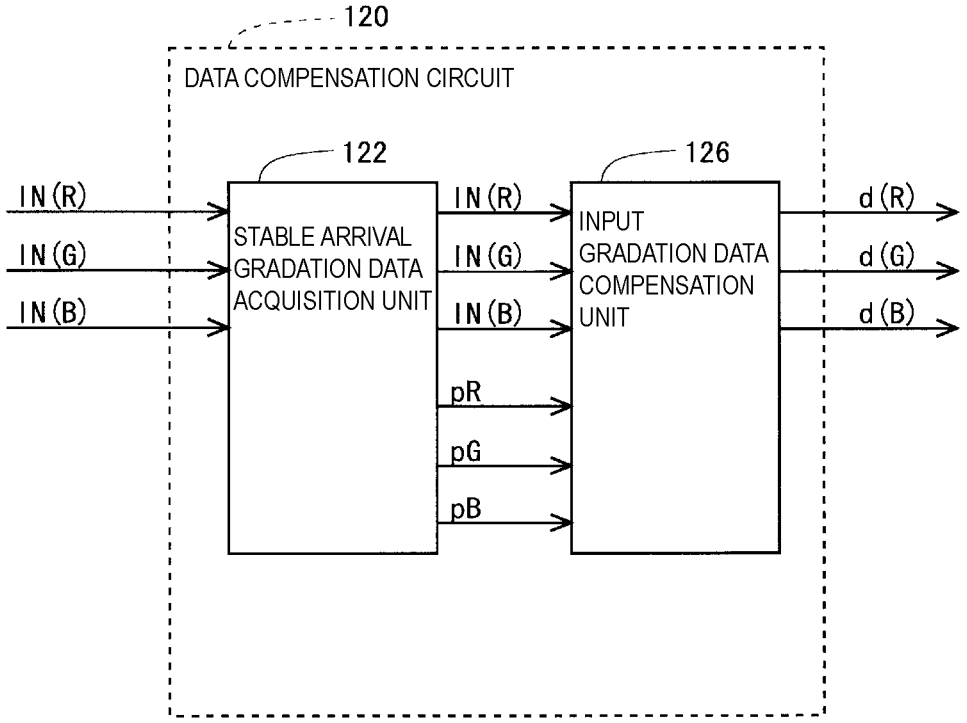
FIG. 13 is a block diagram illustrating a configuration of a data compensation circuit in the first embodiment.

Next, a configuration and an operation of the data compensation circuit 120 will be described in detail. FIG. 13 is a block diagram illustrating a configuration of the data compensation circuit 120 in the present embodiment. The data compensation circuit 120 includes a stable arrival gradation data acquisition unit 122 and the input gradation data compensation unit 126.

The stable arrival gradation data acquisition unit 122 receives the red input gradation data IN (R), the green input gradation data IN (G), and the blue input gradation data IN (B), and outputs arrival gradation data (red arrival gradation data pR, green arrival gradation data pG, and blue arrival gradation data pB) each indicating an arrival gradation estimation value at the start timing of each field of the last frame, in a case where a virtual display process of three or more frames has been performed based on the received data. In the present embodiment, the stable arrival gradation data is enabled by the red arrival gradation data pR, the green arrival gradation data pG, and the blue arrival gradation data pB. Note that the stable arrival gradation data acquisition unit 122 also outputs the red input gradation data IN (R), the green input gradation data IN (G), and the blue input gradation data IN (B), which have been input.

Figure 14:
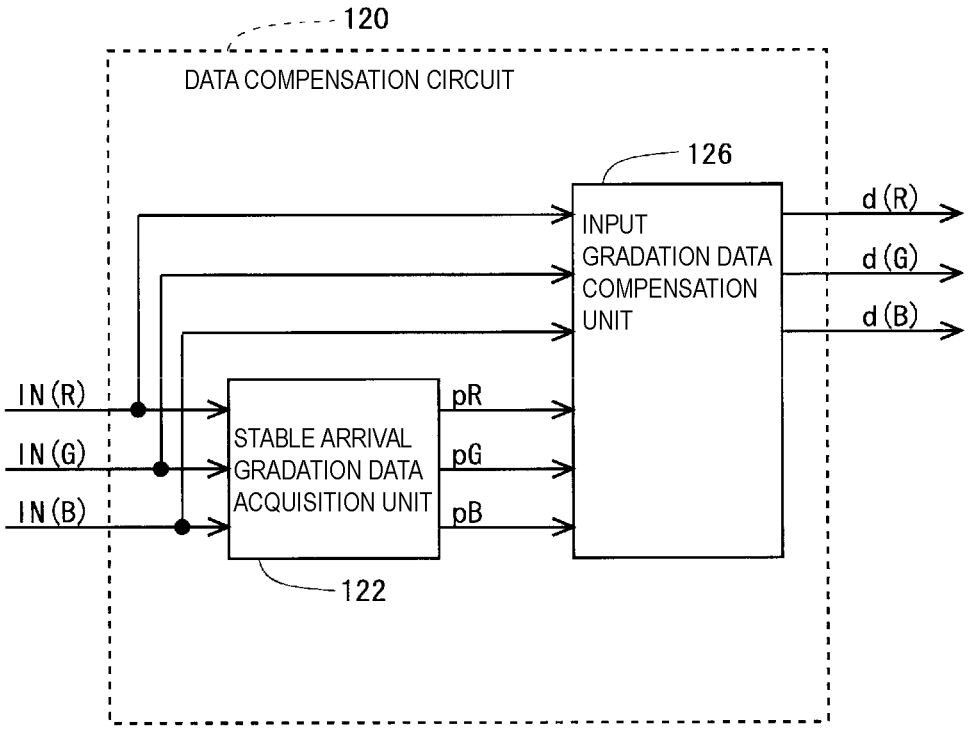
FIG. 14 is a block diagram illustrating another example of a configuration of a data compensation circuit in the first embodiment.

The input gradation data compensation unit 126 outputs writing gradation data (the writing gradation data d (R) for the red field, the writing gradation data d (G) for the green field, and the writing gradation data d (B) for the blue field) corresponding to the actual drive voltage, based on the input gradation data (the red input gradation data IN (R), the green input gradation data IN (G), and the blue input gradation data IN (B)) and the arrival gradation data (the red arrival gradation data pR, the green arrival gradation data pG, and the blue arrival gradation data pB). Note that the configuration illustrated in FIG. 14 may be employed, instead of the configuration illustrated in FIG. 13. That is, input gradation data that has been output from the signal separation circuit 110 (see FIG. 11) may be given directly to the input gradation data compensation unit 126.

1.2.1 Stable Gradation Data Acquisition Unit

FIG. 1 is a block diagram illustrating a detailed configuration of the stable arrival gradation data acquisition unit 122 in the present embodiment. In the present embodiment, the stable arrival gradation data acquisition unit 122 includes 11 arrival gradation value estimation circuits 123 (1) to 123 (11). A configuration of the arrival gradation value estimation circuit 123 is illustrated in FIG. 2. That is, the arrival gradation value estimation circuit 123 includes the application gradation value acquisition circuit 52 and the arrival gradation value acquisition circuit 54. The application gradation value acquisition circuit 52 acquires application gradation data DOUT for the object field, based on the input gradation data IN (D) and the arrival gradation data pIN (the arrival gradation estimation value at the start timing of the object field). The arrival gradation value acquisition circuit 54 acquires the arrival gradation data pOUT (the arrival gradation estimation value at the end timing of the object field), based on the arrival gradation data pIN and the application gradation data DOUT. As described above, the arrival gradation value estimation circuit 123 acquires the arrival gradation estimation value at the end timing of the object field, based on the input gradation value of the object field and the arrival gradation estimation value at the start timing of the object field.

Note that in the present embodiment, the application gradation data acquisition circuit is enabled by the application gradation value acquisition circuit 52, the field arrival gradation data acquisition circuit is enabled by the arrival gradation value acquisition circuit 54, and the field arrival gradation data is enabled by the arrival gradation data pOUT output from the arrival gradation value acquisition circuit 54. Furthermore, in the following description, an x-th frame (where x is an integer from 1 to 4) represents a frame number in the above-mentioned virtual display process.

In the present embodiment, for example, into the arrival gradation value estimation circuit 123 (2) of FIG. 1, arrival gradation data pG (1) indicating an arrival gradation estimation value at the start timing of the green field of the first frame is input as the arrival gradation data pIN, and the green input gradation data IN (G) is input as the input gradation data IN (D). Then, the arrival gradation value estimation circuit 123 (2) outputs arrival gradation data pB (1) indicating an arrival gradation estimation value at the start timing of the blue field (end timing of the green field) of the first frame, as the arrival gradation data pOUT. Furthermore, for example, into the arrival gradation value estimation circuit 123 (10) of FIG. 1, arrival gradation data pR (4) indicating an arrival gradation estimation value at the start timing of the red field of the fourth frame is input as the arrival gradation data pIN, and the red input gradation data IN (R) is input as the input gradation data IN (D). Then, the arrival gradation value estimation circuit 123 (10) outputs arrival gradation data pG (4) indicating an arrival gradation estimation value at the start timing of the green field (end timing of the red field) of the fourth frame, as the arrival gradation data pOUT.

With a configuration as described above, the eleven arrival gradation value estimation circuits 123 (1) to 123 (11) sequentially estimate the arrival gradation values at the end timing of the object field. At a time point when the processing up to the arrival gradation value estimation circuit 123 (3) is finished, the arrival gradation estimation value at the end timing of the first frame, that is, at the start timing of the second frame, is acquired. At a time point when the processing up to the arrival gradation value estimation circuit 123 (6) is finished, the arrival gradation estimation value at the end timing of the second frame, that is, at the start timing of the third frame, is acquired.

At a time point when the processing up to the arrival gradation value estimation circuit 123 (9) is finished, the arrival gradation estimation value at the end timing of the third frame, that is, at the start timing of the fourth frame, is acquired. That is, the arrival gradation value estimation circuit 123 (9) acquires the arrival gradation data pR (4) indicating an arrival gradation estimation value at the start timing of the red field of the fourth frame in a case where it is assumed that a display process of four frames has been performed. Furthermore, the arrival gradation value estimation circuit 123 (10) acquires the arrival gradation data pG (4) indicating an arrival gradation estimation value at the start timing of the green field of the fourth frame in a case where it is assumed that a display process of four frames has been performed. Moreover, the arrival gradation value estimation circuit 123 (11) acquires arrival gradation data pB (4) indicating an arrival gradation estimation value at the start timing of the blue field of the fourth frame in a case where it is assumed that a display process of four frames has been performed. Then, the stable arrival gradation data acquisition unit 122 outputs the arrival gradation data pR (4), the arrival gradation data pG (4), and the arrival gradation data pB (4), respectively as the red arrival gradation data pR, the green arrival gradation data pG, and the blue arrival gradation data pB.

As described above, in the present embodiment, the arrival gradation data (red arrival gradation data pR, green arrival gradation data pG, and blue arrival gradation data pB) indicating the arrival gradation estimation value at the start timing of each field of the fourth frame when a virtual display process of four frames is performed, based on input gradation data of one frame, is applied to the input gradation data compensation unit 126 (see FIG. 13).

1.2.2 Input Gradation Data Compensation Unit

A configuration of the input gradation data compensation unit 126 in the present embodiment is illustrated in FIG. 10. An application gradation value acquisition circuit 52 (R) for the red field outputs, in each frame, application gradation data, as the writing gradation data d (R) for the red field, to be acquired based on the red input gradation data IN (R) and the red arrival gradation data pR. An application gradation value acquisition circuit 52 (G) for the green field outputs, in each frame, application gradation data, as the writing gradation data d (G) for the green field, to be acquired based on the green input gradation data IN (G) and the green arrival gradation data pG. An application gradation value acquisition circuit 52 (B) for the blue field outputs, in each frame, application gradation data, as the writing gradation data d (B) for the blue field, to be acquired based on the blue input gradation data IN (B) and the blue arrival gradation data pB. Note that application gradation data that becomes the writing gradation data for each field is acquired, as described above, by using, for example, a lookup table for acquiring application gradation value as illustrated in FIG. 6.

In the present embodiment, by providing the input gradation data compensation unit 126 having a configuration as described above, the writing gradation data (drive voltage) in each of the red field, the green field, and the blue field is acquired in consideration of an arrival gradation estimation value at the start timing of each field of the fourth frame in the case where a display process (virtual display process) of four frames has been performed based on an input gradation value of one frame.

1.3 Effect

According to the present embodiment, the stable arrival gradation data acquisition unit 122 in the data compensation circuit 120 acquires the arrival gradation estimation value at the start timing of each field of the fourth frame in a case where it is assumed that a display process of four frames has been performed, based on input gradation data of one frame. The input gradation data compensation unit 126 in the data compensation circuit 120 acquires writing gradation data in each field, based on the input gradation value and the arrival gradation estimation value (an arrival gradation estimation value at the start timing of each of the fields) that has been acquired by the stable arrival gradation data acquisition unit 122. Then, during a period while a still image is being displayed, the liquid crystal is driven by using the writing gradation data that has been acquired as described above. As described above, in each field, a compensation to enhance a temporal change in the input gradation value between two consecutive fields is performed in consideration of the liquid crystal state at the start timing of the field. Accordingly, even when the liquid crystal state changes while the backlight is lighting, an occurrence of a color shift is prevented and a desired display luminance is achieved in each field. Furthermore, by using an arrival gradation estimation value that is data acquired from a virtual display process of four frames to acquire writing gradation data corresponding to the actual drive voltage, a color displayed at each pixel when a still image is displayed are converged to a color of a certain RGB combination. This prevents a shift of the liquid crystal state (a shift of the arrival gradation value) from changing in each frame. As a result, an occurrence of flickering is prevented. Furthermore, a difference between the liquid crystal application voltage at a writing time in the positive polarity and the liquid crystal application voltage at a writing time in the negative polarity is substantially reduced. As a result, an occurrence of image sticking is prevented. Therefore, in the present embodiment, a field sequential liquid crystal display device capable of preventing an occurrence of a color shift without causing flickering or image sticking is achieved.

2. Second Embodiment

2.1 Overview

In the above-described first embodiment, the display sequence of the primary colors in each frame is determined for each device. On the other hand, in the present embodiment, the display sequence of the primary colors in a frame can be controlled by a constitution element (a display sequence determination unit 128 described later) provided in the liquid crystal display device. Note that only points different from the above-described first embodiment will be described below.

Figure 15:
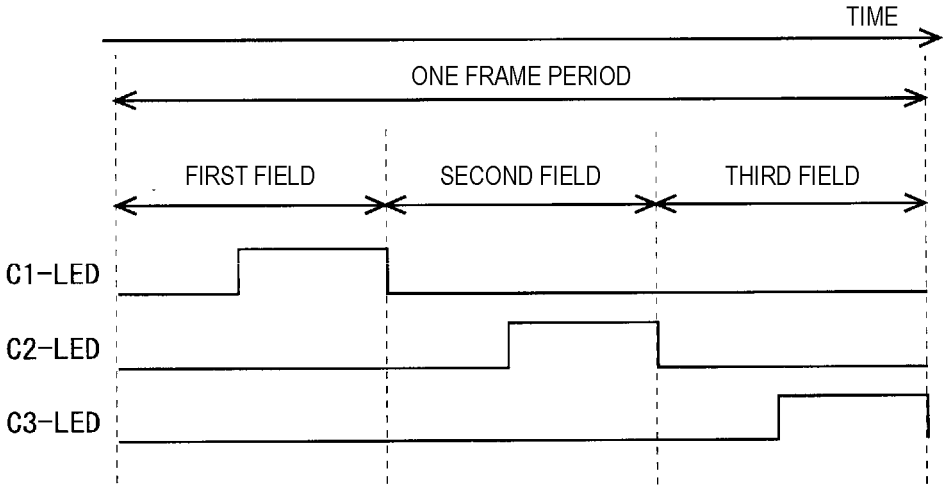
FIG. 15 is a diagram illustrating a configuration of one frame period in a second embodiment of the present invention.

FIG. 15 is a diagram illustrating a configuration of one frame period in the present embodiment. One frame period is divided into a first field for displaying a first primary color screen based on a first primary color component of the input image signal DIN, a second field for displaying a second primary color screen based on a second primary color component of the input image signal DIN, and a third field for displaying a third primary color screen based on a third primary color component of the input image signal DIN. In the first field, an LED of the first primary color (C1-LED) becomes on state, after a predetermined period has elapsed from the start timing of the field. In the second field, an LED of the second primary color (C2-LED) becomes on state, after a predetermined period has elapsed from the start timing of the field. In the third field, an LED of the third primary color (C3-LED) becomes on state, after a predetermined period has elapsed from the start timing of the field. During the operation of the liquid crystal display device, the first field, the second field, and the third field are repeated. Note that, for example, in a case where the display sequence of the primary colors in a frame is a sequence of "blue, green, and red", the first primary color is determined as blue, the second primary color is determined as green, and the third primary color is determined to be red.

2.2 Configuration

Figure 16:
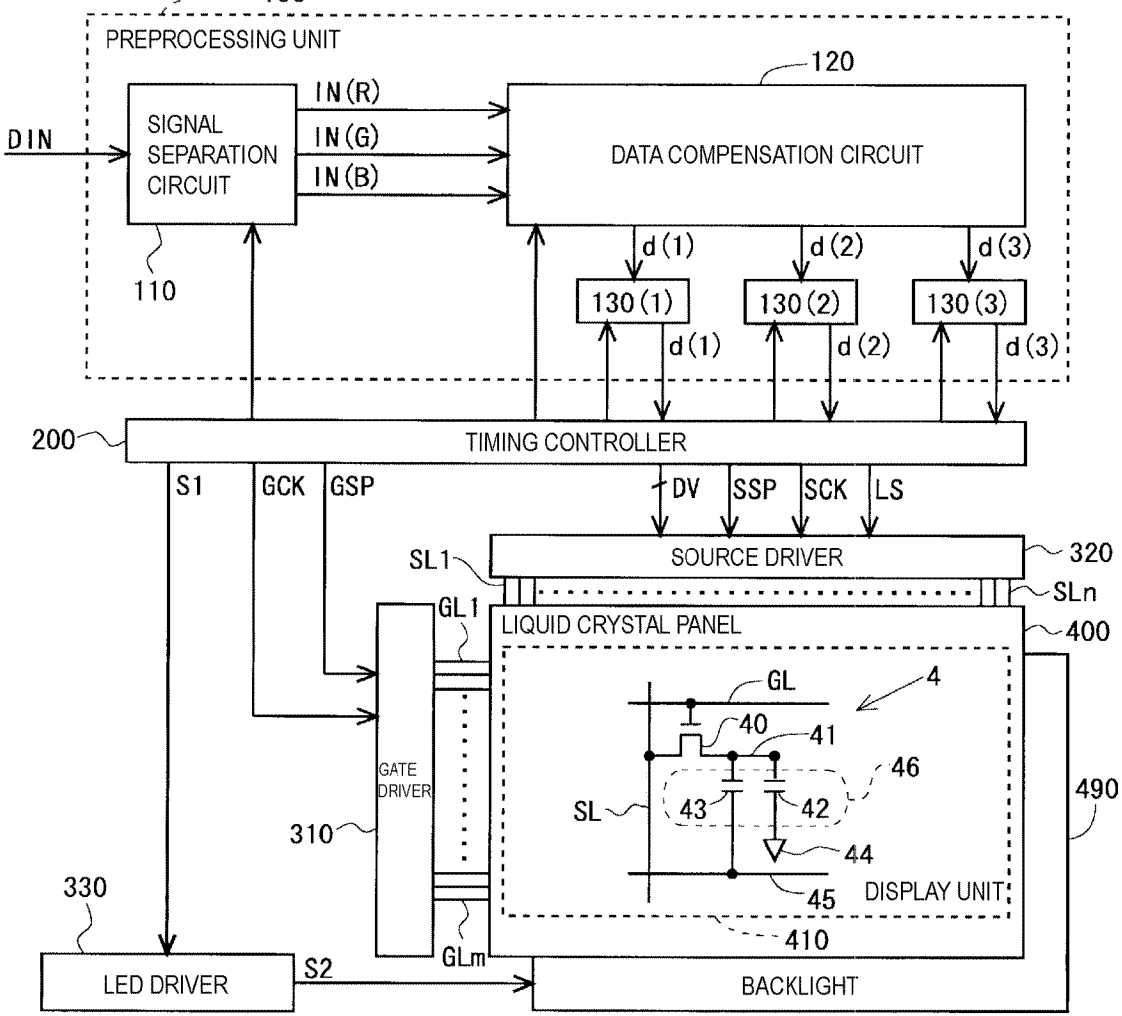
FIG. 16 is a block diagram illustrating an overall configuration of a liquid crystal display device in the second embodiment.

FIG. 16 is a block diagram illustrating an overall configuration of the liquid crystal display device in the present embodiment. In the present embodiment, a first field memory 130 (1), a second field memory 130 (2), and a third field memory 130 (3) are provided in the preprocessing unit 100, instead of the red field memory 130 (R), the green field memory 130 (G), and the blue field memory 130 (B) of the first embodiment. The data compensation circuit 120 respectively outputs, as the writing gradation data, writing gradation data d (1) to d (3) for the first to third fields. For example, in a case where the display sequence of the primary colors in a frame is a sequence of "blue, green, and red", the data compensation circuit 120 outputs writing gradation data for blue as the writing gradation data d (1), writing gradation data for green as the writing gradation data d (2), and writing gradation data for red as the writing gradation data d (3).

In the first field memory 130 (1), the second field memory 130 (2), and the third field memory 130 (3), the writing gradation data d (1) for the first field, the writing gradation data d (2) for the second field, and the writing gradation data d (3) for the third field that have been output from the data compensation circuit 120 are stored, respectively. The timing controller 200 retrieves writing gradation data d (1) for the first field, the writing gradation data d (2) for the second field, and the writing gradation data d (3) for the third field.

Figure 17:
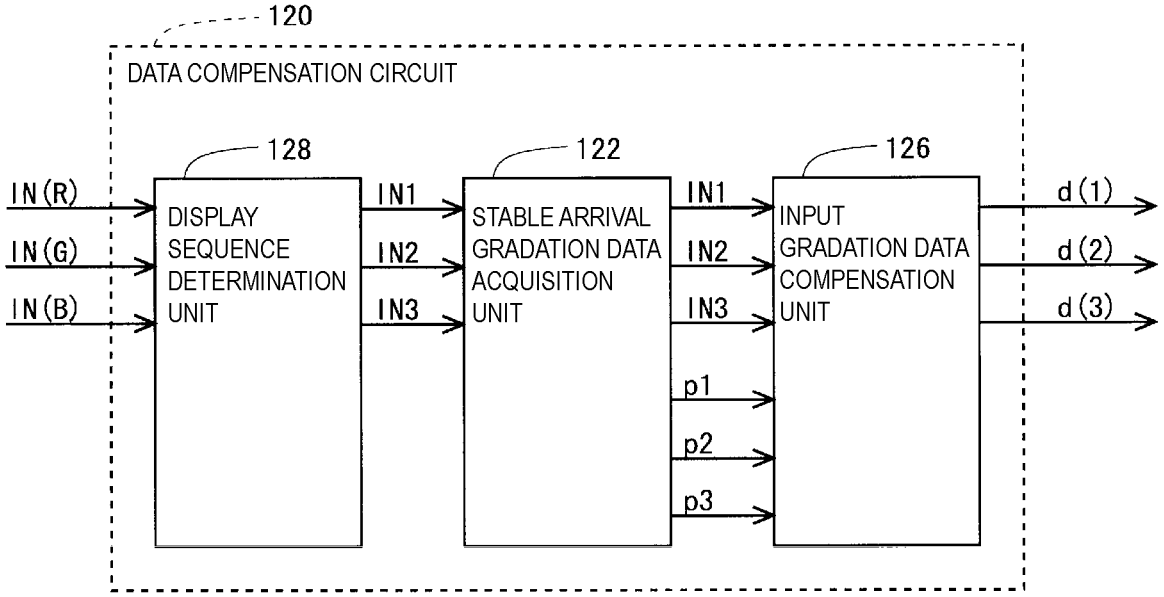
FIG. 17 is a block diagram illustrating a configuration of a data compensation circuit in the second embodiment.

FIG. 17 is a block diagram illustrating a configuration of the data compensation circuit 120 in the present embodiment. The data compensation circuit 120 in the present embodiment includes a stable arrival gradation data acquisition unit 122 and an input gradation data compensation unit 126, and a display sequence determination unit 128. Note that a field assignment unit is enabled by the display sequence determination unit 128. The display sequence determination unit 128 receives red input gradation data IN (R) green input gradation data IN (G), and blue input gradation data IN (B) and outputs first input gradation data IN1, second input gradation data IN2, and third input gradation data IN3 to correspond to the display sequence of the primary colors in a frame. For example, in a case where the display sequence of the primary colors in the frame is the sequence of "blue, green, and red", the blue input gradation data IN (B) is output as the first input gradation data IN1, the green input gradation data IN (G) is output as the second input gradation data IN2, and the red input gradation data IN (R) is output as the third input gradation data IN3.

Figure 18:
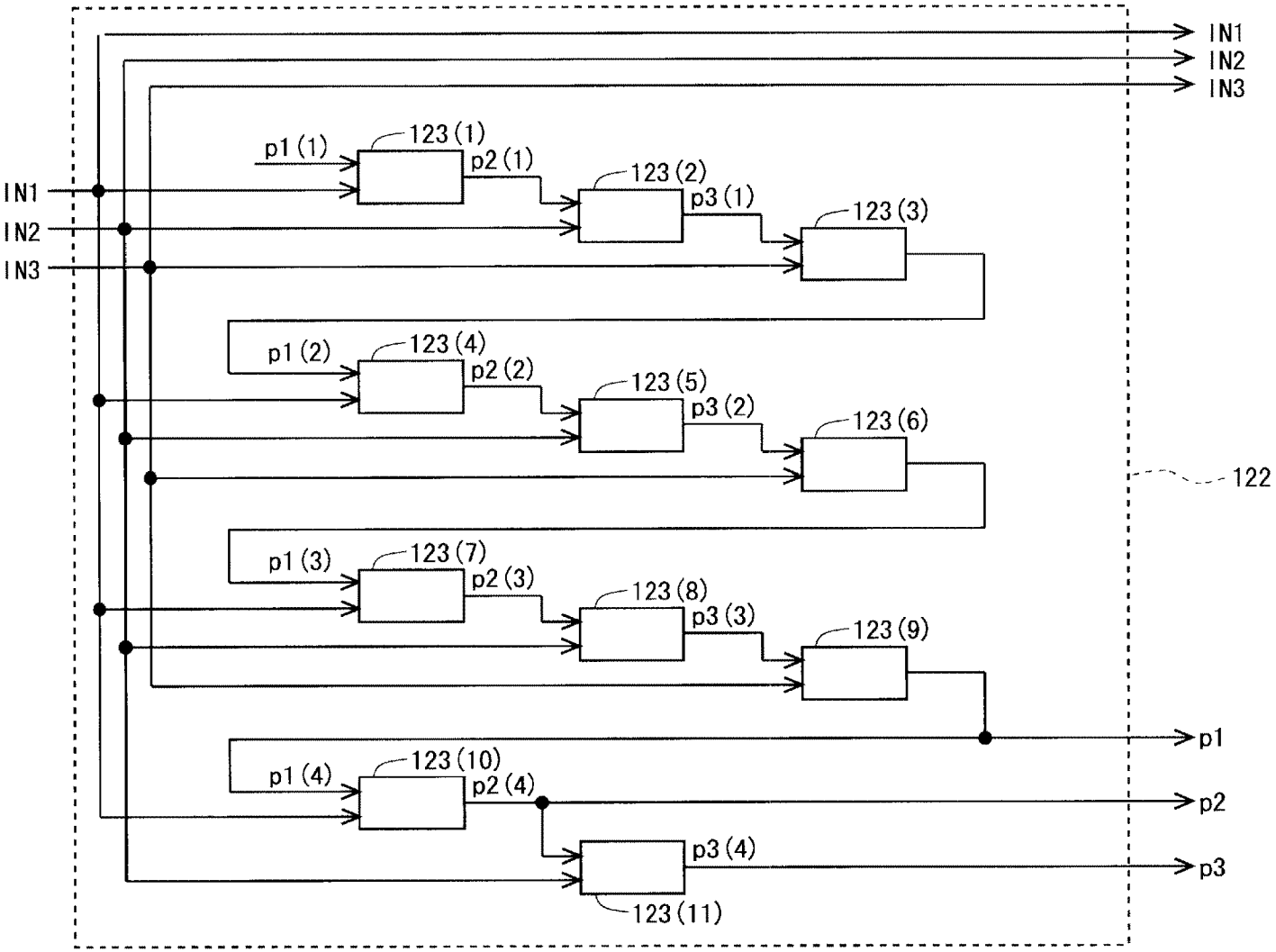
FIG. 18 is a block diagram illustrating a detailed configuration of a stable arrival gradation data acquisition unit in the second embodiment.

FIG. 18 is a block diagram illustrating a detailed configuration of the stable arrival gradation data acquisition unit 122 in the present embodiment. In a similar manner to the above-described first embodiment (FIG. 1), the stable arrival gradation data acquisition unit 122 includes eleven arrival gradation value estimation circuits 123 (1) to 123 (11). Then, by performing a similar process to the process in the first embodiment based on the first to third input gradation data IN1 to IN3, arrival gradation data (first arrival gradation data p1, second arrival gradation data p2, and third arrival gradation data p3), indicating the arrival gradation estimation value at the start timing of each field of the fourth frame in a case where a virtual display process of four frames has been performed based on input gradation data of one frame, is applied to the input gradation data compensation unit 126.

The input gradation data compensation unit 126 (see FIG. 17) performs a similar process to the process in the above-described first embodiment, based on the first to third input gradation data IN1 to IN3 and the first to third arrival gradation data p1 to p3, to generate the writing gradation data d (1) to d (3) for the first to third fields.

2.3 Effect

According to the present embodiment, a liquid crystal display device capable of achieving a similar effect to the first embodiment is enabled without increasing a circuit scale, regardless of the display sequence of the primary colors in the frame.

3. Third Embodiment

3.1 Overview

Figure 19:
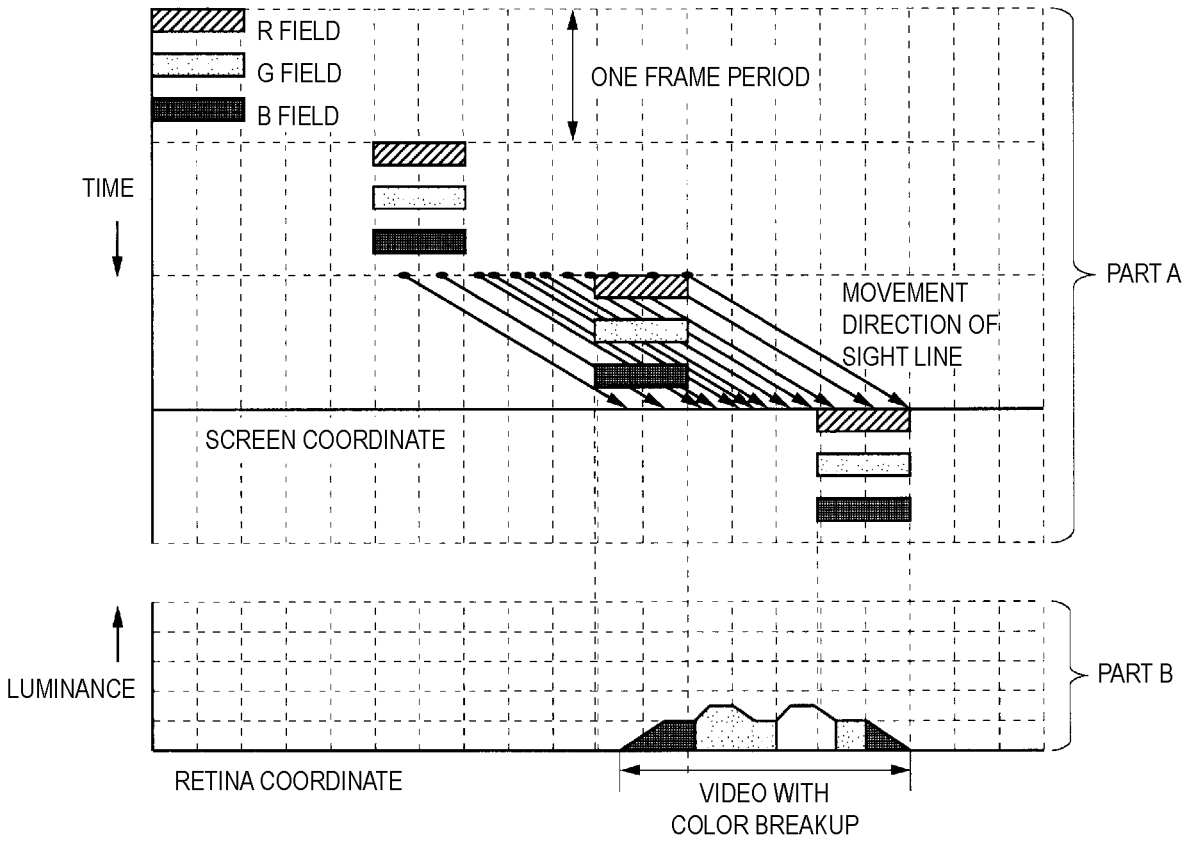
FIG. 19 is a diagram illustrating a principle of generating a color breakup.

Regarding a field sequential color liquid crystal display device, an issue of color breakup (color break) is known in the related art. FIG. 19 is a diagram illustrating the principle of such a color breakup. In part A of FIG. 19, the vertical axis expresses time and the horizontal axis expresses position on a screen. Typically, when an object moves in a display screen, observer's line of sight follows the object and moves in a moving direction of the object. For example, in the example illustrated in FIG. 19, when a white object moves from the left to the right in the display screen, the observer's line of sight moves in directions of slanted arrows. On the other hand, when the three field images R, G, and B are extracted from a video at the same moment, a location of the object in each field image is the same. Thus, as illustrated in part B of FIG. 19, a color breakup occurs in the video reflected on the retina. As a solution to such a color breakup, a field for displaying non-primary colors, that is, a field for displaying a screen by using at least two colors (mixed color display), in one frame period. Specifically, by providing a white field for displaying a white screen in one frame period, an occurrence of the color breakup is effectively prevented. Therefore, in the present embodiment, a white field is provided in one frame period.

Figure 20:
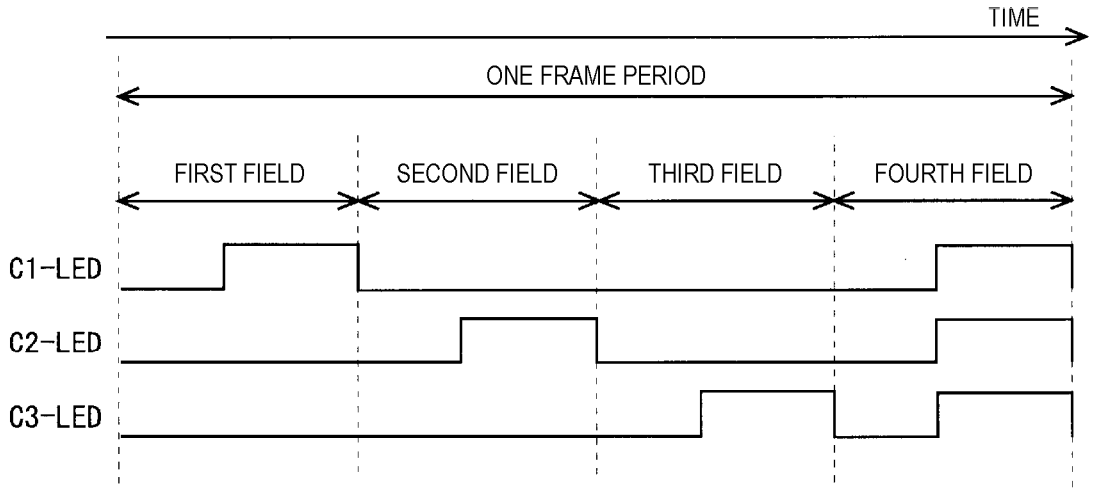
FIG. 20 is a diagram illustrating one example of a configuration of one frame period in a third embodiment of the present invention.

FIG. 20 is a diagram illustrating one example of a configuration of one frame period in the present embodiment. As illustrated in FIG. 20, in the present embodiment, one frame period is divided into four fields (first to fourth fields). A red field, a green field, a blue field, and a white field are respectively assigned to the first to fourth fields. Note that, in the example illustrated in FIG. 20, the white field is assigned to the fourth field. In the fourth field (the white field), a red LED, a green LED, and a blue LED become on state, after a predetermined period has elapsed from the start timing of the field.

3.2 Configuration

Figure 21:
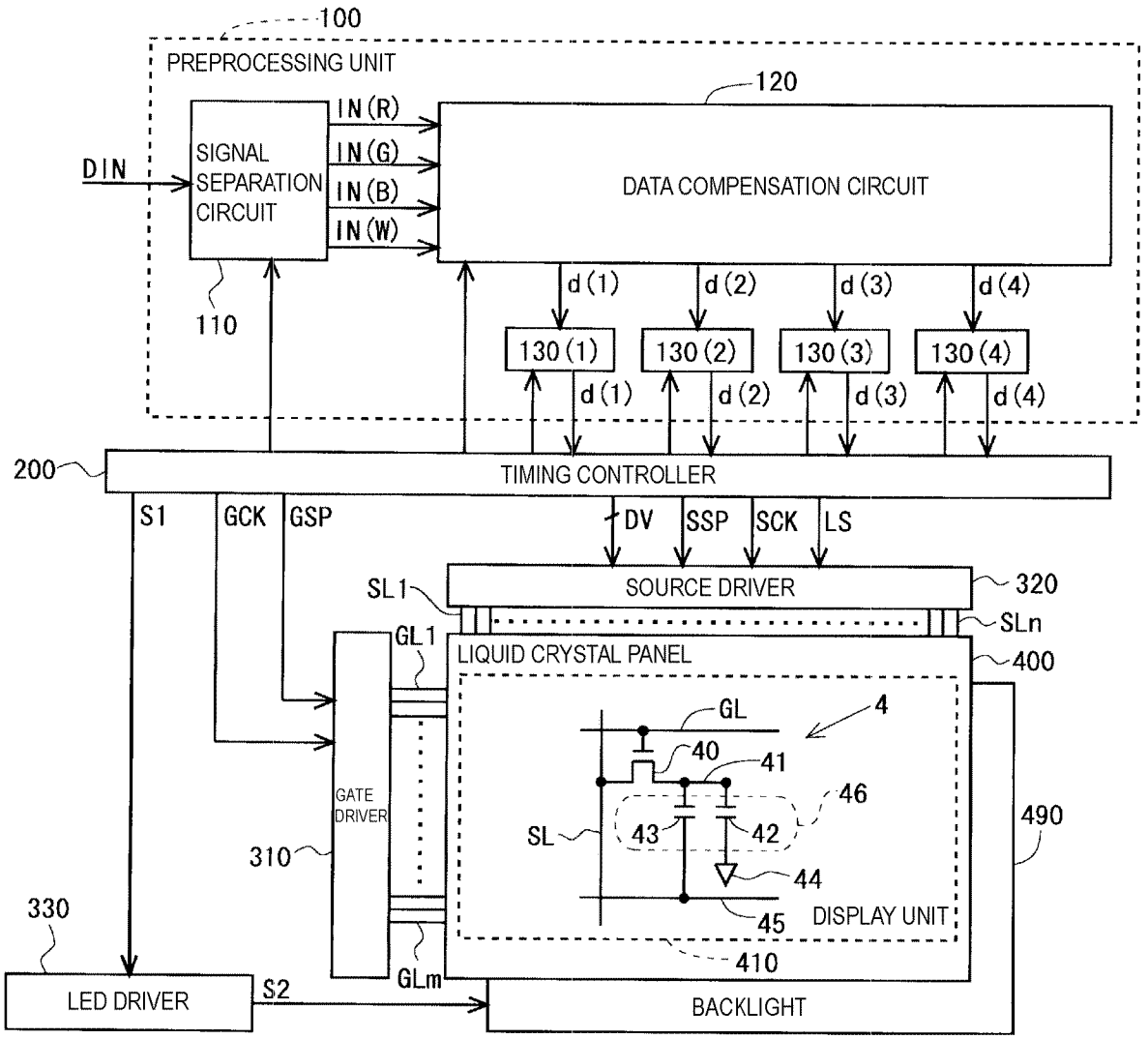
FIG. 21 is a block diagram illustrating an overall configuration of a liquid crystal display device in the third embodiment.

FIG. 21 is a block diagram illustrating an overall configuration of the liquid crystal display device in the present embodiment. In the present embodiment, the preprocessing unit 100 includes a fourth field memory 130 (4), in addition to the constitution elements that have been described in the above-described second embodiment. Writing gradation data d (4) for the fourth field is output from a data compensation circuit 120, and is stored in this fourth field memory 130 (4).

The signal separation circuit 110 in the preprocessing unit 100 separates an input image signal DIN supplied from the outside into red input gradation data IN (R), green input gradation data IN (G), blue input gradation data IN (B), and white color input gradation data IN (W).

The data compensation circuit 120 in the preprocessing unit 100 compensates the input gradation data (red input gradation data IN (R), green input gradation data IN (G), blue input gradation data IN (B), and white color input gradation data IN (W)), which have been output from the signal separation circuit 110, into data associated with a voltage (a drive voltage) applied to the liquid crystal panel 400, and outputs the compensated data as writing gradation data. The writing gradation data output from the data compensation circuit 120 includes the writing gradation data d (1) to d (4) for the first to fourth field.

Figure 22:
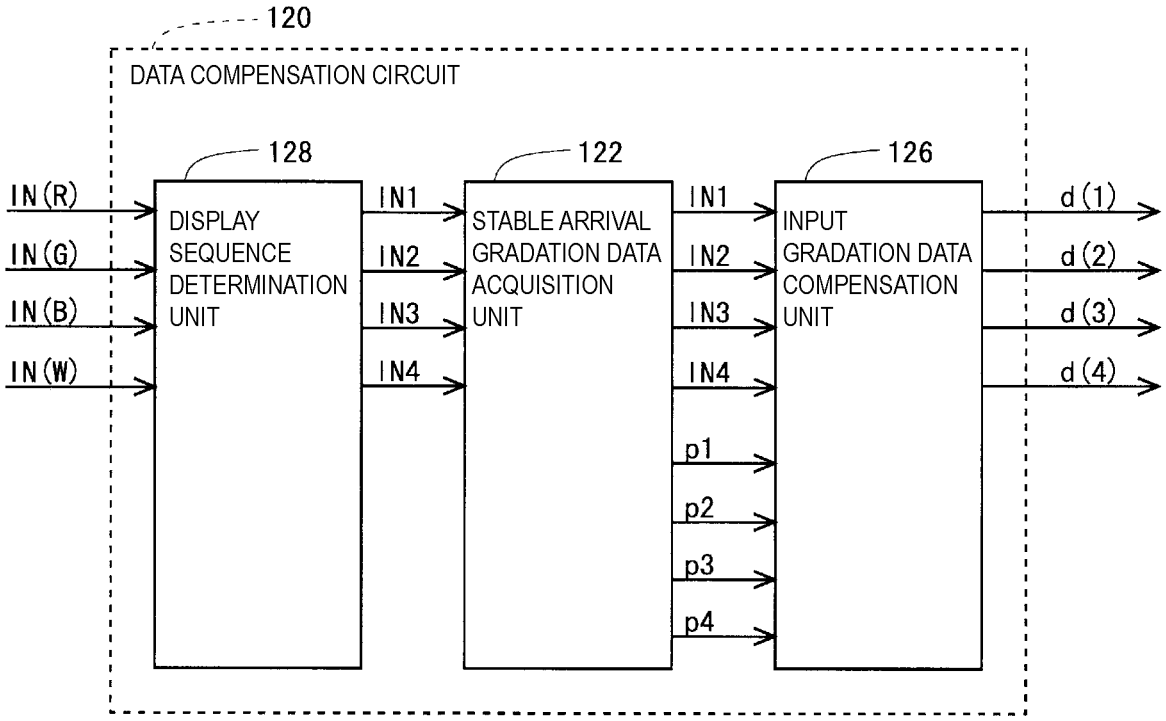
FIG. 22 is a block diagram illustrating a configuration of a data compensation circuit in the third embodiment.

FIG. 22 is a block diagram illustrating a configuration of the data compensation circuit 120 in the present embodiment. In a similar manner to the above-described second embodiment (see FIG. 17), the data compensation circuit 120 includes a display sequence determination unit 128, a stable arrival gradation data acquisition unit 122, and an input gradation data compensation unit 126. Except that the number of fields constituting one frame period is "4", the data compensation circuit 120 in the present embodiment performs a similar process to the process of the data compensation circuit 120 in the above-described second embodiment.

Figure 23:
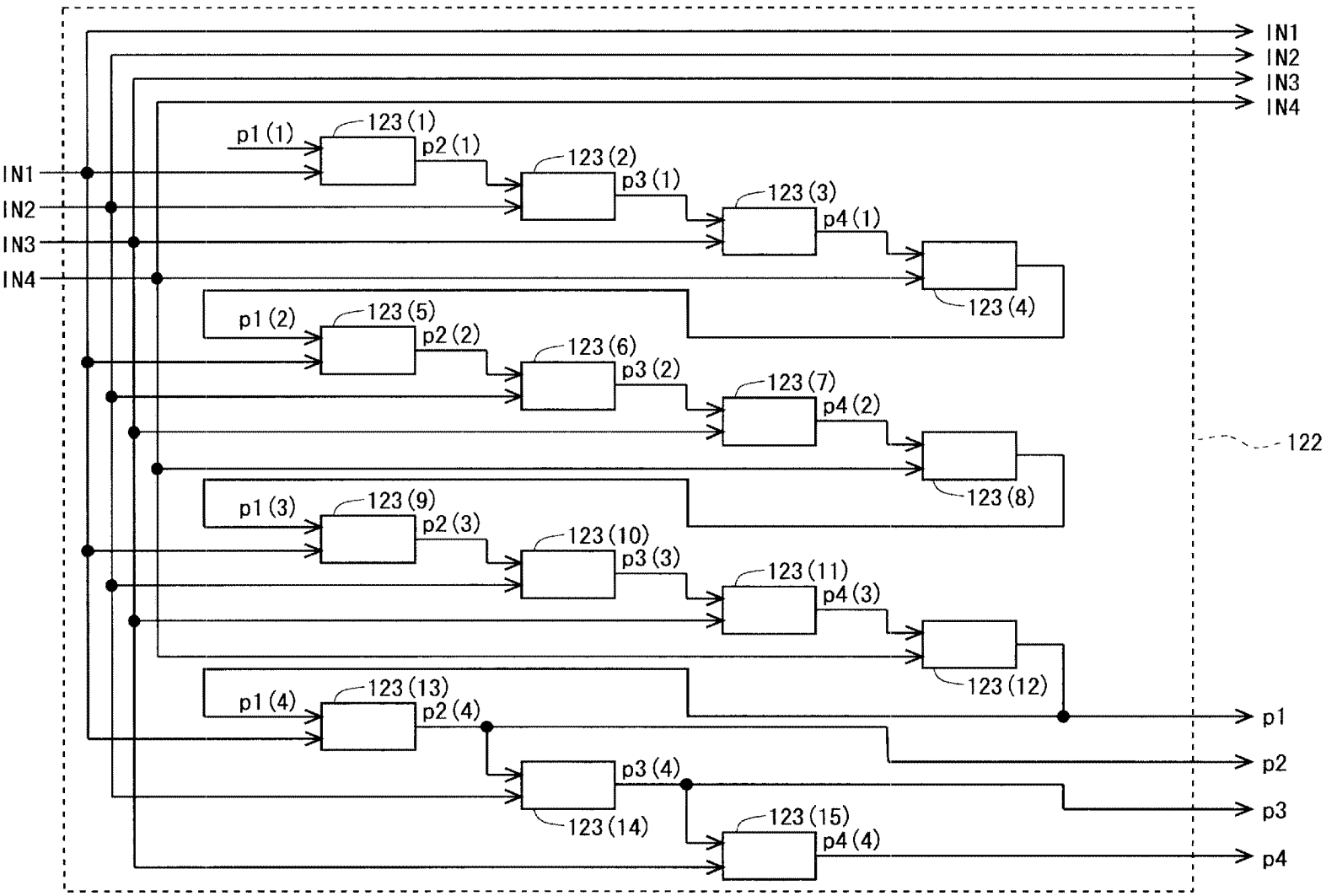
FIG. 23 is a block diagram illustrating a detailed configuration of a stable arrival gradation data acquisition unit in the third embodiment.

FIG. 23 is a block diagram illustrating a detailed configuration of the stable arrival gradation data acquisition unit 122 in the present embodiment. The stable arrival gradation data acquisition unit 122 includes fifteen arrival gradation value estimation circuits 123 (1) to 123 (15). The fifteen arrival gradation value estimation circuits 123 (1) to 123 (15) sequentially estimate arrival gradation values at the end timing of the object field. At a time point when the processing up to the arrival gradation value estimation circuit 123 (4) is finished, the arrival gradation estimation value at the end timing of the first frame, that is, at the start timing of the second frame, is acquired. At a time point when processing up to the arrival gradation value estimation circuit 123 (8) is finished, the arrival gradation estimation value at the end timing of the second frame, that is, at the start timing of the third frame, is acquired.

At a time point when processing up to the arrival gradation value estimation circuit 123 (12) is finished, the arrival gradation estimation value at the end timing of the third frame, that is, at the start timing of the fourth frame, is acquired. That is, the arrival gradation value estimation circuit 123 (12) acquires arrival gradation data p1 (4) indicating an arrival gradation estimation value at the start timing of the first field of the fourth frame in a case where it is assumed that a display process of four frames is performed. Furthermore, the arrival gradation value estimation circuit 123 (13) acquires arrival gradation data p2 (4) indicating an arrival gradation estimation value at the start timing of the second field of the fourth frame in a case where it is assumed that a display process of four frames is performed. Moreover, the arrival gradation value estimation circuit 123 (14) acquires arrival gradation data p3 (4) indicating an arrival gradation estimation value at the start timing of the third field of the fourth frame in a case where it is assumed that a display process of four frames is performed. Furthermore, the arrival gradation value estimation circuit 123 (15) acquires arrival gradation data p4 (4) indicating an arrival gradation estimation value at the start timing of the fourth field of the fourth frame in a case where it is assumed that a display process of four frames is performed. Then, the arrival gradation data p1 (4), the arrival gradation data p2 (4), the arrival gradation data p3 (4), and the arrival gradation data p4 (4) are respectively output as first arrival gradation data p1, second arrival gradation data p2, third arrival gradation data p3, and fourth arrival gradation data p4, from the stable arrival gradation data acquisition unit 122.

3.3 Effect

According to the present embodiment, one frame period includes the white field in which a mixed color component of the three primary colors is displayed, in addition to the three fields in which the respective three primary colors are displayed. Thus, an occurrence of the color breakup is prevented. Therefore, a field sequential liquid crystal display device capable of preventing an occurrence of a color shift or a color breakup is achieved without causing flickering or image sticking.

3.4 Modification

In the above-described third embodiment, the white field is included in one frame period; however, the present invention is not limited to such a configuration. The present invention is also applicable to a case where a field for displaying a mixed color screen other than white is included in one frame period.

4. Fourth Embodiment

4.1 Overview

In the above-described first embodiment and the above-described second embodiment, one frame period includes three fields. Furthermore, in the above-described third embodiment, one frame period includes four fields. In the fourth embodiment, on the other hand, one frame period can be switched between three fields and four fields.

4.2 Configuration

Figure 24:
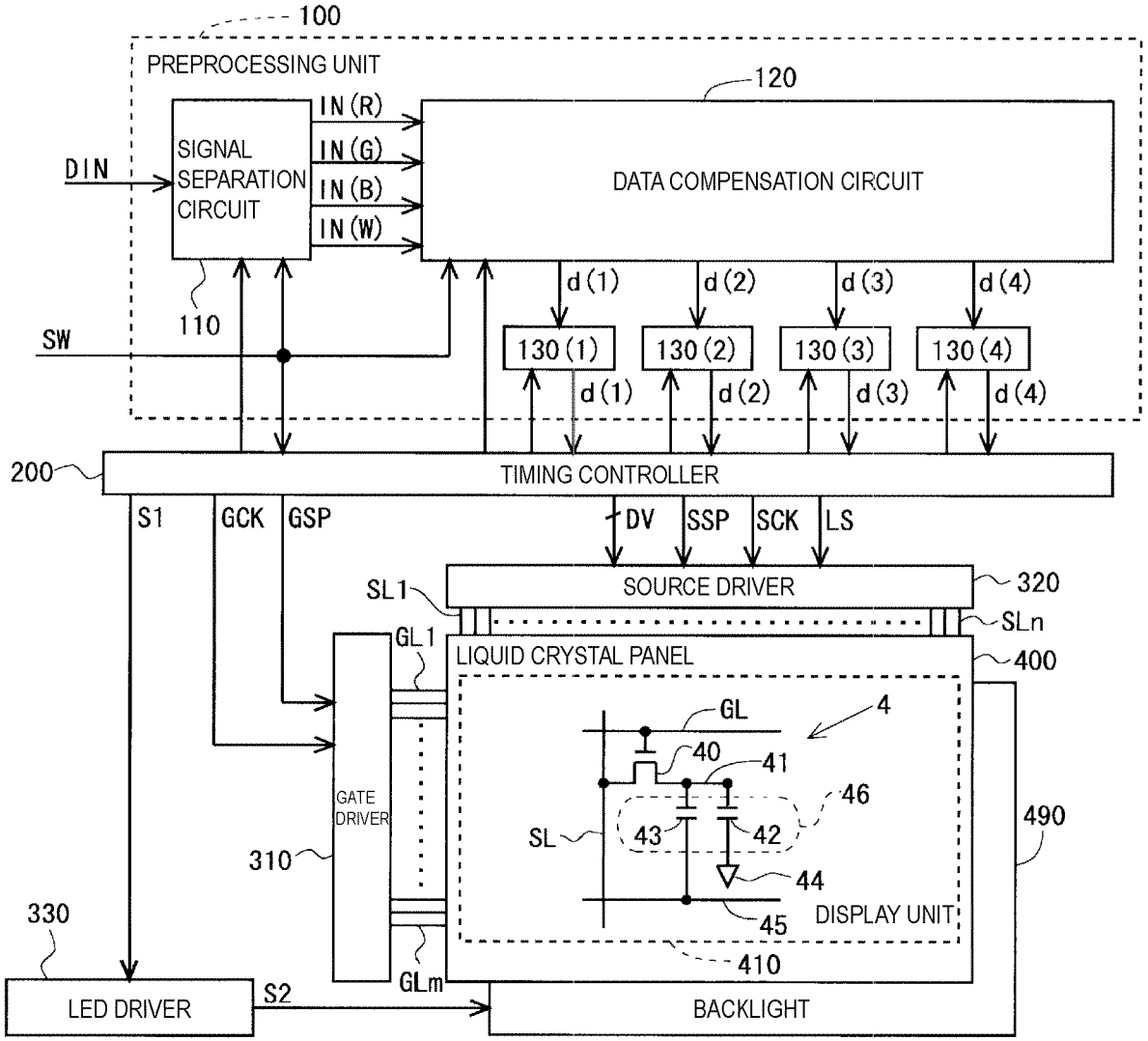
FIG. 24 is a block diagram illustrating an overall configuration of a liquid crystal display device in a fourth embodiment of the present invention.

FIG. 24 is a block diagram illustrating an overall configuration of the liquid crystal display device in the present embodiment. In a configuration similar to the configuration in the above-described third embodiment (see FIG. 21), a switching signal SW for switching the field number is given to a signal separation circuit 110, a data compensation circuit 120, and a timing controller 200. The switching signal SW indicates either "three fields" or "four fields". Note that a field number signal is enabled by the switching signal SW.

In a case where the switching signal SW indicates three fields, the signal separation circuit 110 separates the input image signal DIN into the red input gradation data IN (R), the green input gradation data IN (G), and the blue input gradation data IN (B). In a case where the switching signal SW indicates four fields, the signal separation circuit 110 separates the input image signal DIN into the red input gradation data IN (R), the green input gradation data IN (G), the blue input gradation data IN (B), and the white color input gradation data IN (W).

In a case where the switching signal SW indicates three fields, the data compensation circuit 120 compensates the red input gradation data IN (R), the green input gradation data IN (G), and the blue input gradation data IN (B) to become data associated with the drive voltage, and outputs the compensated data as the writing gradation data d (1) to d (3) for the first to third fields. In a case where the switching signal SW indicates four fields, the data compensation circuit 120 compensates the red input gradation data IN (R), the green input gradation data IN (G), the blue input gradation data IN (B), and the white color input gradation data IN (W) to become data associated with the drive voltage, and outputs the compensated data as the writing gradation data d (1) to d (4) for the first to fourth field.

In a case where the switching signal SW indicates three fields, the timing controller 200 retrieves the writing gradation data d (1) to d (3) for the first to third fields from the first to third field memories 130 (1) to 130 (3) and outputs the digital video signal DV and the like. In a case where the switching signal SW indicates four fields, the timing controller 200 retrieves the writing gradation data d (1) to d (4) for the first to fourth fields from the first to fourth field memories 130 (1) to 130 (4) and outputs the digital video signal DV and the like. Furthermore, in a case where the switching signal SW indicates three fields, the timing controller 200 outputs an LED driver control signal S1 to control the state of the LED, for example, as illustrated in FIG. 15. In a case where the switching signal SW indicates four fields, the timing controller 200 outputs the LED driver control signal S1 to control the state of the LED, for example, as illustrated in FIG. 20.

In such a manner, in the case where the switching signal SW indicates three fields, the display unit 410 sequentially displays the three primary colors, and in the case where the switching signal SW indicates four fields, the display unit 410 sequentially displays the three primary colors and the white color.

Figure 25:
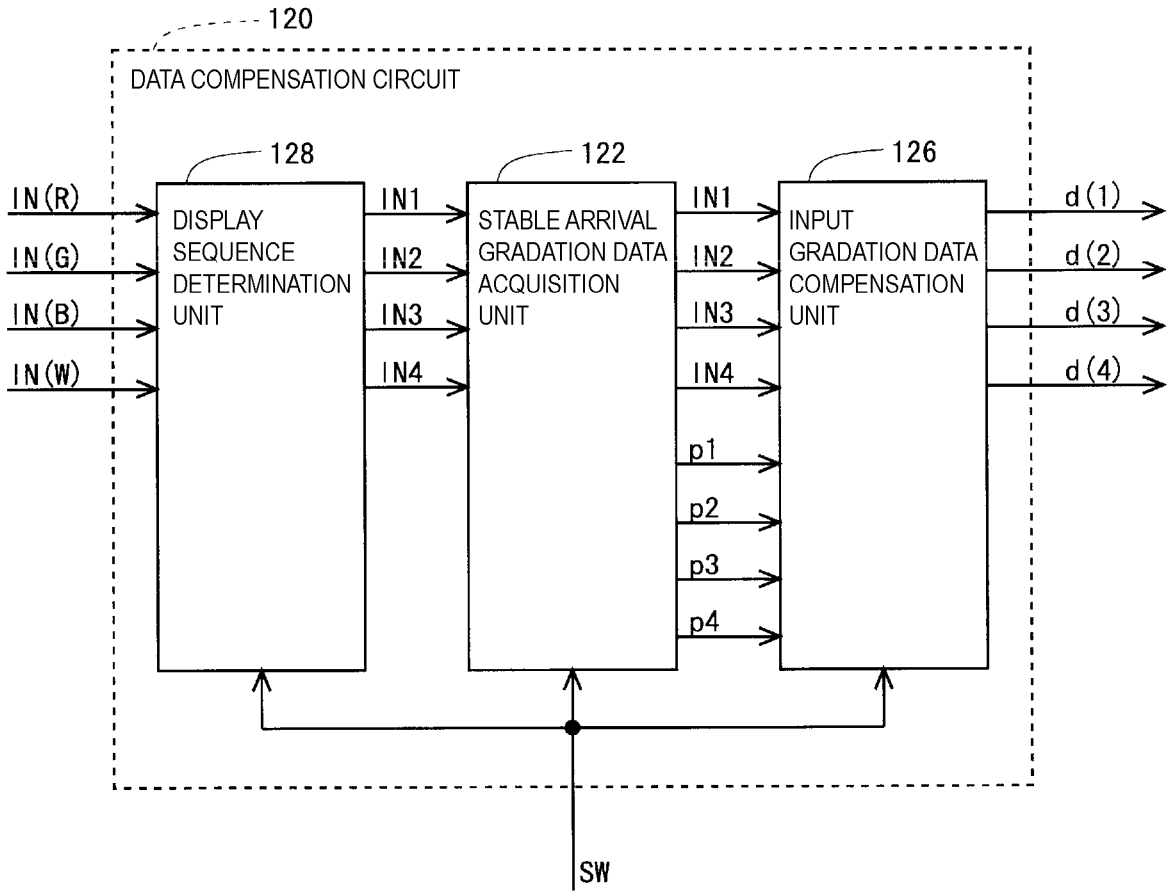
FIG. 25 is a block diagram illustrating a configuration of a data compensation circuit in the fourth embodiment.

FIG. 25 is a block diagram illustrating a configuration of the data compensation circuit 120 in the present embodiment. In a configuration similar to the configuration in the above-described second embodiment (see FIG. 22), the switching signal SW is given to a display sequence determination unit 128, a stable arrival gradation data acquisition unit 122, and an input gradation data compensation unit 126.

In a case where the switching signal SW indicates three fields, the display sequence determination unit 128 receives the red input gradation data IN (R), the green input gradation data IN (G), and the blue input gradation data IN (B) and outputs the first to third input gradation data IN1 to IN3 according to the display sequence of the primary colors in the frame. In a case where the switching signal SW indicates four fields, the display sequence determination unit 128 receives the red input gradation data IN (R), the green input gradation data IN (G), the blue input gradation data IN (B), and the white color input gradation data IN (W) and outputs the first to fourth input gradation data IN1 to IN4 according to the display sequence of the primary colors and the white color in the frame.

In a case where the switching signal SW indicates three fields, the stable arrival gradation data acquisition unit 122 generates the first to third arrival gradation data p1 to p3, based on the first to third input gradation data IN1 to IN3, and outputs the first to third input gradation data IN1 to IN3 and the first to third arrival gradation data p1 to p3. In a case where the switching signal SW indicates four fields, the stable arrival gradation data acquisition unit 122 generates the first to fourth arrival gradation data p1 to p4, based on the first to fourth input gradation data IN1 to IN4, and outputs the first to fourth input gradation data IN1 to IN4 and the first to fourth arrival gradation data p1 to p4.

In a case where the switching signal SW indicates three fields, the input gradation data compensation unit 126 outputs the writing gradation data d (1) to d (3) for the first to third fields, based on the first to third input gradation data IN1 to IN3 and the first to third arrival gradation data p1 to p3. In a case where the switching signal SW indicates four fields, the input gradation data compensation unit 126 outputs the writing gradation data d (1) to d (4) for the first to fourth field, based on the first to fourth input gradation data IN1 to IN4 and the first to fourth arrival gradation data p1 to p4.

Figure 26:
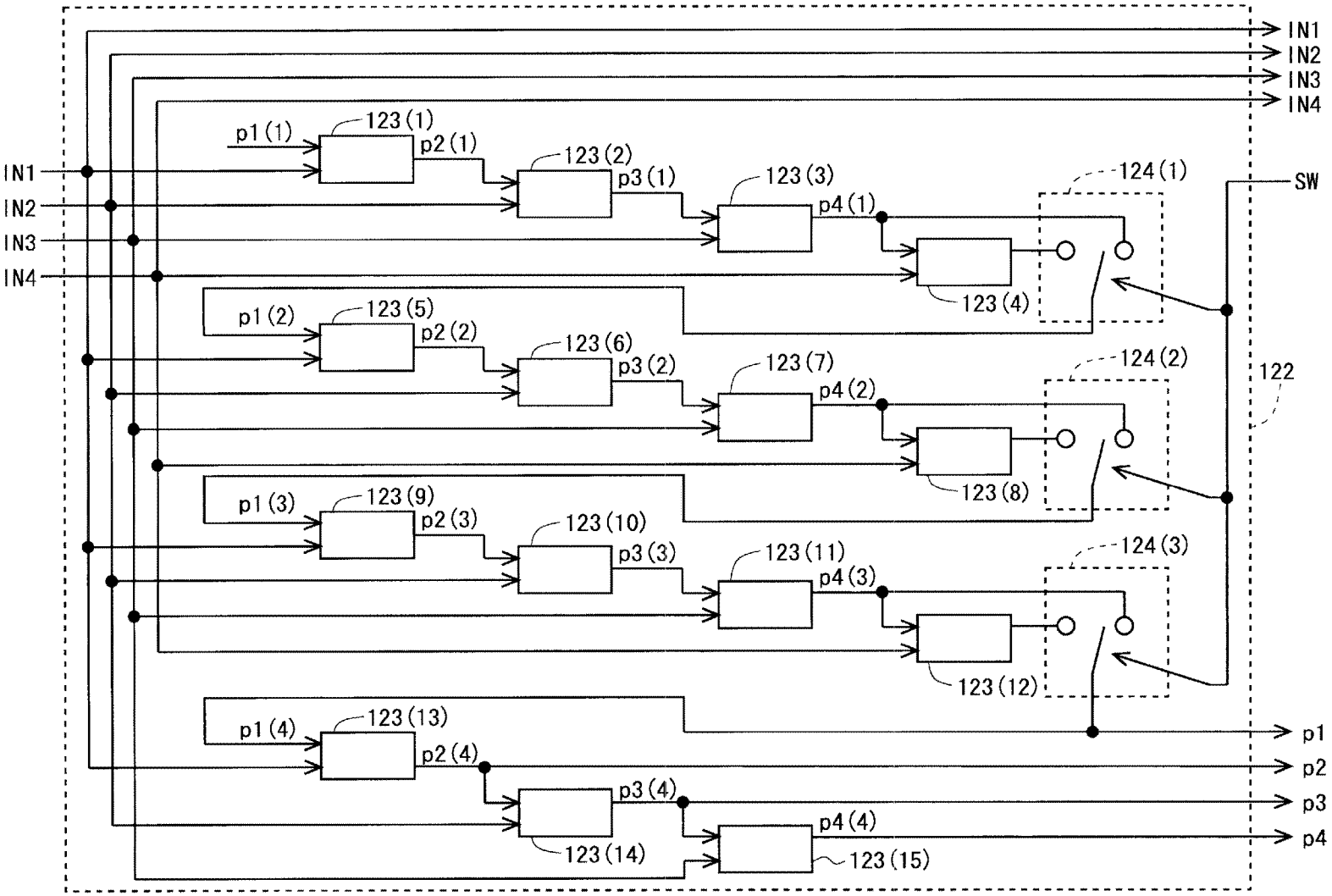
FIG. 26 is a block diagram illustrating a detailed configuration of a stable arrival gradation data acquisition unit in the fourth embodiment.

FIG. 26 is a block diagram illustrating a detailed configuration of the stable arrival gradation data acquisition unit 122 in the present embodiment. In the present embodiment, the stable arrival gradation data acquisition unit 122 includes connection switching circuits 124 (1) to 124 (3) for performing an internal process in accordance with the field number, in addition to the constitution elements in the above-described third embodiment (see FIG. 23).

For example, the connection switching circuit 124 (1) controls a connection of the arrival gradation value estimation circuits 123 (3) to 123 (5) as follows. In a case where the switching signal SW indicates three fields, the connection switching circuit 124 (1) controls the connection such that an output from the arrival gradation value estimation circuit 123 (3) is given to the arrival gradation value estimation circuit 123 (5). In a case where the switching signal SW indicates four fields, the connection switching circuit 124 (1) controls the connection such that an output from the arrival gradation value estimation circuit 123 (4) is given to the arrival gradation value estimation circuit 123 (5). By controlling the connection in such a manner, in a case where one frame period is configured with three fields, the arrival gradation value estimation circuit 123 (5) performs processing with an arrival gradation estimation value acquired by the arrival gradation value estimation circuit 123 (3) being an arrival gradation value at the start timing of the second frame. In a case where one frame period is configured with four fields, the arrival gradation value estimation circuit 123 (5) performs processing with an arrival gradation estimation value acquired by the arrival gradation value estimation circuit 123 (4) being the arrival gradation value at the start timing of the second frame.

As described above, regardless of the number of fields constituting one frame period, arrival gradation data indicating the arrival gradation estimation value at the start timing of each field of the fourth frame, in a case where it is assumed that a display process of four frames is performed based on input gradation data for one frame, is correctly acquired and given to the input gradation data compensation unit 126.

4.3 Effect

According to the present embodiment, in addition to a similar effect to the first embodiment, the number of fields in one frame period is switched between three fields and four fields depending on the displayed image. For example, when an image in which a color breakup easily occurs is displayed, one frame period may include four fields.

5. Fifth Embodiment

5.1 Overview

In the above-described first to fourth embodiments, the descriptions have been given using the field sequential liquid crystal display device as an example; however, the present invention is not limited to this example. The present invention is also applicable to a liquid crystal display device configured to display the primary colors by using a plurality of fields (subframes) to increase display gradations. Therefore, in the following description, an example in which the present invention is applied to a liquid crystal display device employing a color filter system, configured to display the respective primary colors (red, green, and blue) by using three fields will be described, as a fifth embodiment.

In the present embodiment, one frame period includes three fields (first to third fields). Here, it is assumed that all fields have the same length. However, the lengths of the fields may be different from each other. For example, the length may have a relation of "first field:second field:third field=1:2:4".

In the present embodiment, input gradation data of each primary color is divided into three pieces of field data. Then, for each primary color, three types of drive voltages corresponding to the three pieces of field data are sequentially applied to the liquid crystal in the three fields. Thus, the respective primary colors are displayed for one frame period including three fields.

For example, it is assumed that any one of drive voltages of 256 steps is applied to the liquid crystal panel 400, in each field. In this case, for each primary color, any one of drive voltages of 256 steps is selected, in each of the three fields. That is, gradation display having 768 gradations is achieved. Thereby, display gradations are improved in the liquid crystal display device in this manner in the present embodiment.

5.2 Configuration

Figure 27:
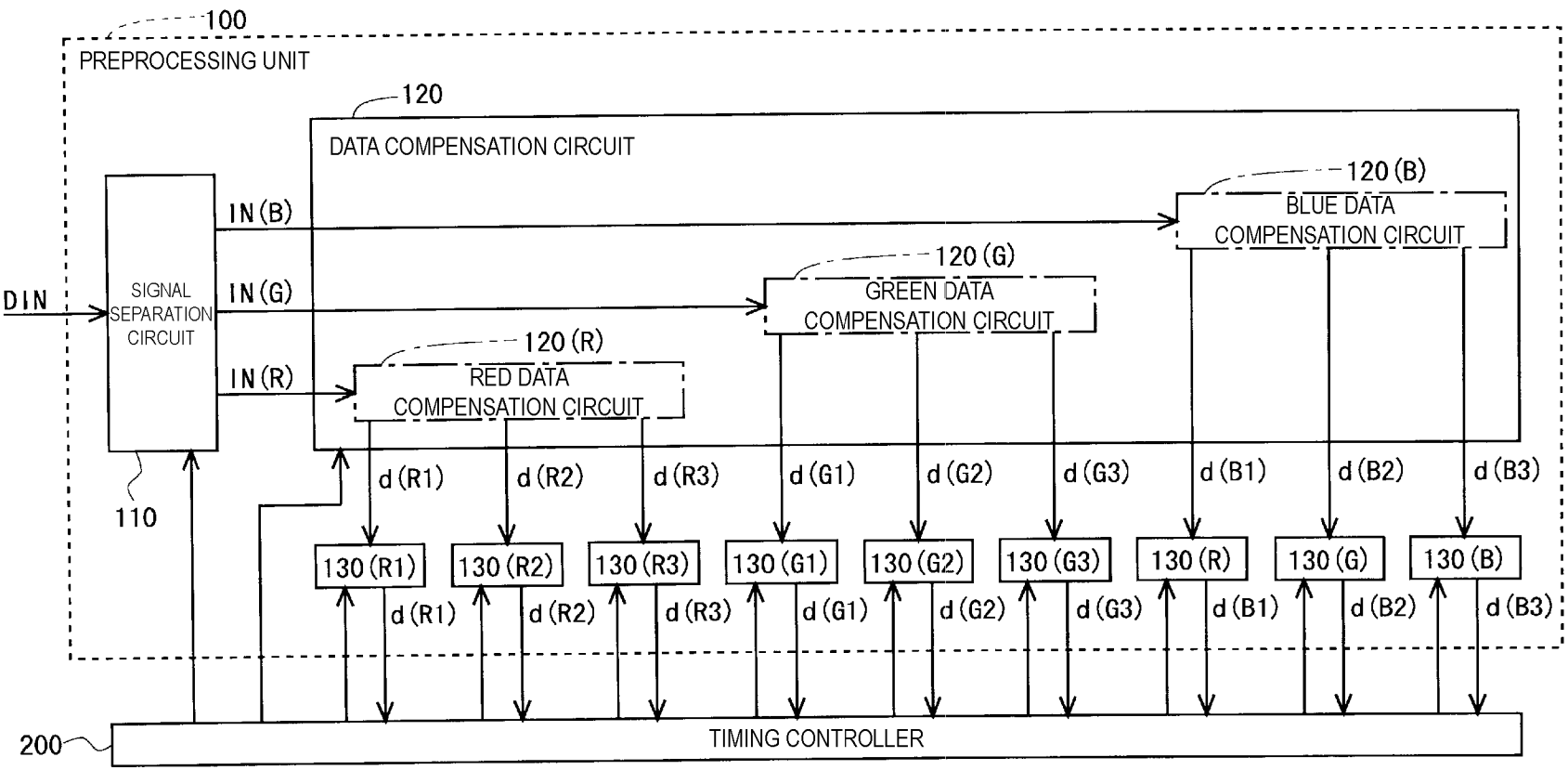
FIG. 27 is a block diagram illustrating a configuration of a preprocessing unit in a fifth embodiment of the present invention.

FIG. 27 is a block diagram illustrating a configuration of a preprocessing unit 100 in the present embodiment. The preprocessing unit 100 includes a signal separation circuit 110, a data compensation circuit 120, and nine field memories 130 (R1), 130 (R2), 130 (R3), 130 (G1), 130 (G2), 130 (G3), 130 (B1), 130 (B2), and 130 (B3). For example, the field memory 130 (G2) stores writing gradation data d (G2) for the second field of green.

As illustrated in FIG. 27, the data compensation circuit 120 includes a red data compensation circuit 120 (R), a green data compensation circuit 120 (G), and a blue data compensation circuit 120 (B). For example, the red data compensation circuit 120 (R) outputs three pieces of writing gradation data d (R1), d (R2), and d (R3) corresponding to the drive voltage in each of the three fields, based on the red input gradation data IN (R) output from the signal separation circuit 110. The green data compensation circuit 120 (G) and the blue data compensation circuit 120 (B) operate in a similar manner.

Figure 28:
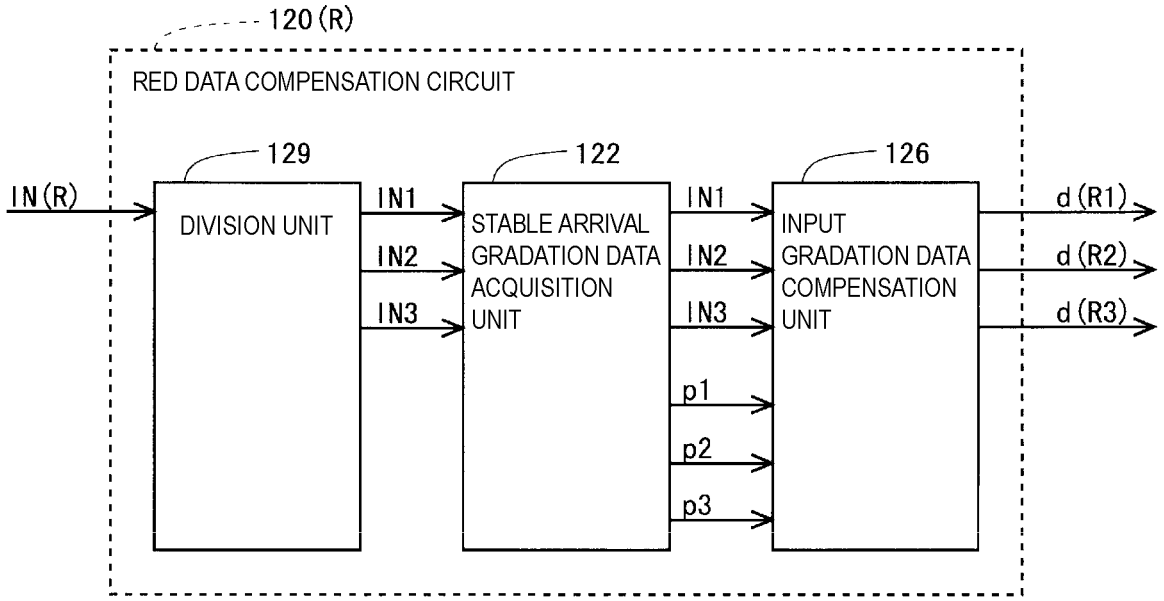
FIG. 28 is a block diagram illustrating a configuration of a red data compensation circuit in the fifth embodiment.
Figure 29:
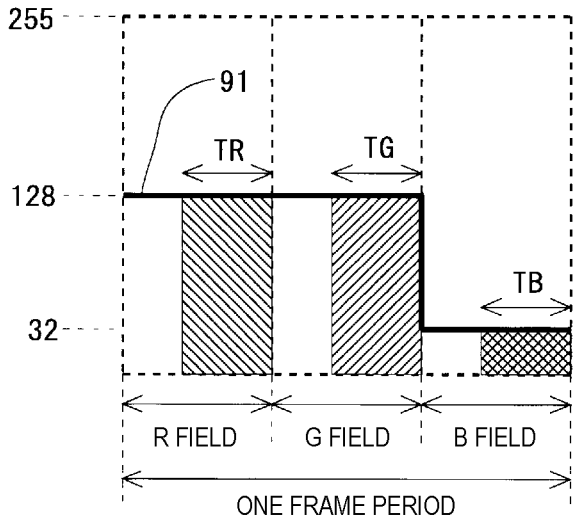
FIG. 29 is a waveform chart illustrating an example of a change of a liquid crystal state in a case that a response characteristic of liquid crystal molecules is ideal.
Figure 30:
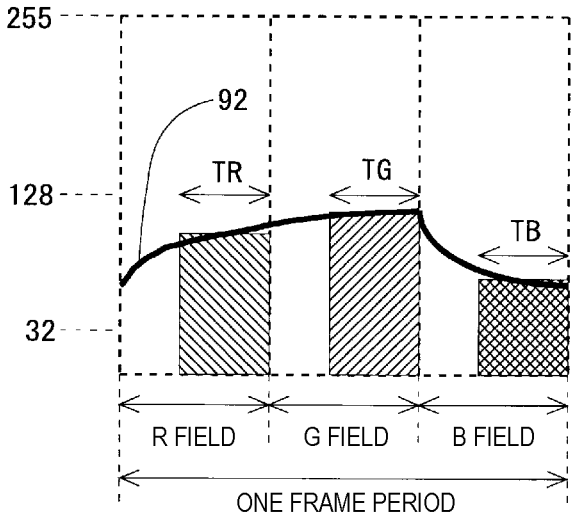
FIG. 30 is a waveform chart illustrating one example of a change of a liquid crystal state in a case that overdrive is not employed.
Figure 31:
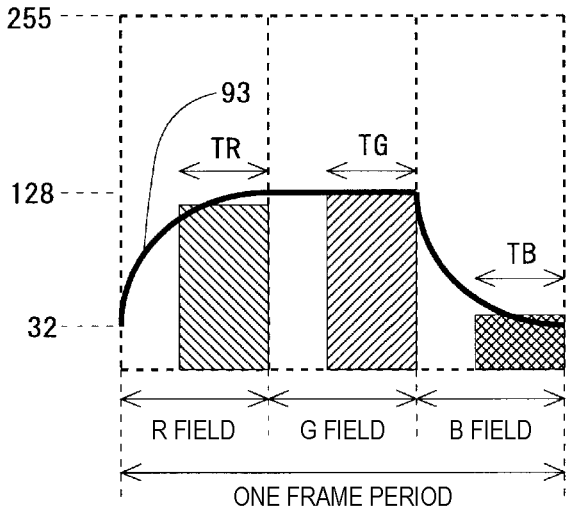
FIG. 31 is a waveform chart illustrating one example of a change of a liquid crystal state in a case that overdrive is employed.
Figure 32:
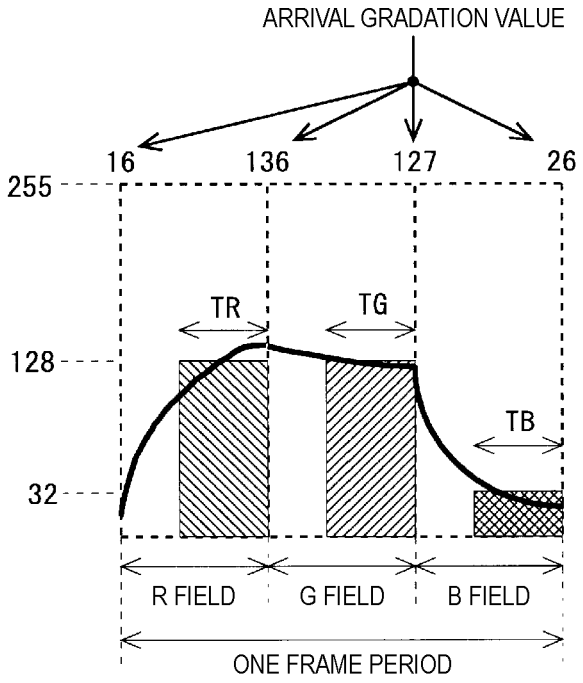
FIG. 32 is a diagram for illustrating a mechanism leading to occurrence of flickering or image sticking when a still image is displayed, in the related art.
Figure 33:
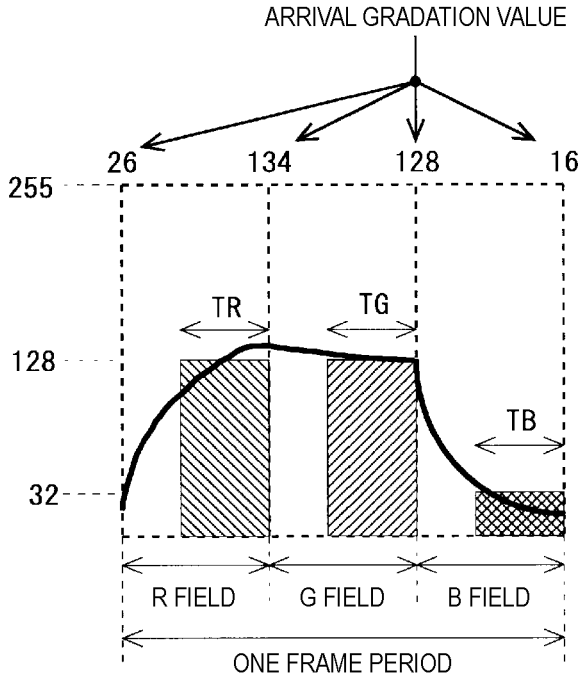
FIG. 33 is a diagram for illustrating a mechanism leading to occurrence of flickering or image sticking when a still image is displayed, in the related art.

FIG. 28 is a block diagram illustrating a configuration of the red data compensation circuit 120 (R). Note that the green data compensation circuit 120 (C) and the blue data compensation circuit 120 (B) also have a similar configuration, and thus the descriptions will be omitted. As illustrated in FIG. 28, the red data compensation circuit 120 (R) includes a division unit 129, a stable arrival gradation data acquisition unit 122, and an input gradation data compensation unit 126. The division unit 129 divides the red input gradation data IN (R) into three pieces of field data. The three pieces of field data are output from the division unit 129, so as to be the first input gradation data IN1, the second input gradation data IN2, and the third input gradation data IN3. For example, in a case where an input gradation value is "300" in a liquid crystal display device configured to achieve the gradation display having 768 gradations, each gradation value may be "a gradation value of the first input gradation data IN1=100, a gradation value of the second input gradation data IN2=100, and a gradation value of the third input gradation data IN3=100", or may be "a gradation value of the first input gradation data. IN1=256, a gradation value of the second input gradation data IN2=44, and a gradation value of the third input gradation data IN3=0". Furthermore, as long as the total of the gradation values of the three pieces of field data amounts to "300", the data IN (R) may be divided in any other way. The three pieces of field data generated by the division unit 129 are given to the stable arrival gradation data acquisition unit 122. The stable arrival gradation data acquisition unit 122 and the input gradation data compensation unit 126 each perform a similar operation to the operation in each of the above-described embodiments.

Thereby, writing gradation data for the three fields for each of the primary colors is output from the data compensation circuit 120. Then, the display unit 410 displays the respective primary colors by using the three fields.

5.3 Effect

According to the present embodiment, an occurrence of a color shift is prevented without causing flickering or image sticking in a liquid crystal display device configured to use a plurality of fields (subframes) to display primary colors to improve display gradations.

6. Additional Remarks

The present invention is not limited to each of the embodiments described above, and various modifications may be made without departing from the scope of the present invention. For example, one frame period may be divided into a greater number of fields than the number of fields described in each of the embodiments above.

REFERENCE SIGNS LIST

52 Application gradation value acquisition circuit
54 Arrival gradation value acquisition circuit
100 Preprocessing unit
110 Signal separation circuit
120 Data compensation circuit
122 Stable arrival gradation data acquisition unit
123, 123 (1) to 123 (15) Arrival gradation value estimation circuit
124 (1) to 124 (3) Connection switching circuit
126 Input gradation data compensation unit
128 Display sequence determination unit
130 (R), 130 (G), 130 (B) Red field memory, green field memory, blue field memory
130 (1) to 130 (4) First to fourth field memories
200 Timing controller
310 Gate driver
320 Source driver
330 LED driver
400 Liquid crystal panel
410 Display unit
490 Backlight

The invention claimed is:

1. A liquid crystal display device including a liquid crystal panel, the liquid crystal display device configured to display an image by dividing one frame period into a plurality of fields and applying, to the liquid crystal panel, for each field, writing gradation data corresponding to a drive voltage, the liquid crystal display device comprising:

a stable arrival gradation data acquisition unit configured to acquire stable arrival gradation data indicating an arrival gradation estimation value at a start timing of each field of a last frame in a case where a virtual display process of three or more frames is performed based on input gradation data for one frame;

an input gradation data compensation unit configured to acquire the writing gradation data by compensating the input gradation data based on the stable arrival gradation data; and a liquid crystal panel drive unit configured to drive the liquid crystal panel based on the writing gradation data, wherein the stable arrival gradation data acquisition unit is configured to acquire the stable arrival gradation data by repeatedly performing, for each field, an arrival gradation value estimation process for acquiring, based on input gradation data for an object field and an arrival gradation estimation value at a start point of the object field, an arrival gradation estimation value at a start timing of a next field in a case where a drive voltage for achieving display luminance corresponding to input gradation data is applied to the liquid crystal panel in an object field, the input gradation data compensation unit is configured to acquire the writing gradation data to achieve the display luminance corresponding to the input gradation data in the plurality of fields in a case where an arrival gradation value at a start timing of each of the plurality of fields serves as an arrival gradation estimation value indicated by the stable arrival gradation data, the stable arrival gradation data acquisition unit includes a plurality of arrival gradation value estimation circuits configured to perform the arrival gradation value estimation process, each of the plurality of arrival gradation value estimation circuits comprising:

an application gradation data acquisition circuit configured to receive first input data and second input data, and to acquire application gradation data corresponding to a drive voltage for achieving display luminance corresponding to the first input data in an object field, in a case where an arrival gradation value at a start timing of the object field serves as an arrival gradation estimation value indicated by the second input data; and a field arrival gradation data acquisition circuit configured to receive the second input data and the application gradation data, and to acquire, in a case where the arrival gradation value at the start timing of the object field serves as the arrival gradation estimation value indicated by the second input data, field arrival gradation data indicating an arrival gradation estimation value at a start timing of a next field in a case where a drive voltage corresponding to the application gradation data is applied to the liquid crystal panel, input gradation data for an object field is given, as the first input data, to each of the plurality of arrival gradation value estimation circuits, and in a case where two arrival gradation value estimation circuits provided to correspond to two consecutive fields for a virtual display process are defined as a preceding arrival gradation value estimation circuit and a succeeding arrival gradation value estimation circuit, field arrival gradation data acquired by the field arrival gradation data acquisition circuit included in the preceding arrival gradation value estimation circuit is given, as the second input data, to the succeeding arrival gradation value estimation circuit.

2. The liquid crystal display device according to claim 1, wherein the input gradation data compensation unit comprises at least one application gradation data acquisition circuit equal in number to the number of fields constituting the one frame period, input gradation data for an object field is given, as the first input data, and stable arrival gradation data for the object field is given, as the second input data, to the application gradation data acquisition circuit included in the input gradation data compensation unit, and the application gradation data is output, as the writing gradation data, from the application gradation data acquisition circuit included in the input gradation data compensation unit.

3. The liquid crystal display device according to claim 1, wherein the stable arrival gradation data acquisition unit further includes at least one connection switching circuit in accordance with the number of frames, for each of which a virtual display process is performed, the at least one connection switching circuit being configured to control a connection between the plurality of arrival gradation value estimation circuits in accordance with a field number signal indicating the number of fields constituting the one frame period, and each of the connection switching circuits is configured to control the connection between the plurality of arrival gradation value estimation circuits to give field arrival gradation data, as the second input data, to an arrival gradation value estimation circuit, the field arrival gradation data being acquired by the field arrival gradation data acquisition circuit included in an arrival gradation value estimation circuit, in accordance with the field number signal, of a plurality of arrival gradation value estimation circuits provided to correspond to the plurality of fields in the preceding frame for a virtual display process, the arrival gradation value estimation circuit being provided to correspond to a first field of the succeeding frame for the virtual display process.

4. The liquid crystal display device according to claim 1, further comprising a field assignment unit configured to assign the input gradation data to the plurality of fields, based on a display sequence of colors in a frame, wherein in acquiring the stable arrival gradation data, the stable arrival gradation data acquisition unit is configured to perform a virtual display process based on sequential data serving as data acquired by the field assignment unit assigning the input gradation data to the plurality of fields.

5. The liquid crystal display device according to claim 1, wherein the one frame period is divided into a plurality of fields to display a color screen different for each of the plurality of fields.

6. The liquid crystal display device according to claim 5, wherein the one frame period is divided into three fields including a red field configured to display a red screen, a green field configured to display a green screen, and a blue field configured to display a blue screen.

7. The liquid crystal display device according to claim 5, wherein the one frame period includes a field configured to display a mixed color screen.

8. The liquid crystal display device according to claim 7, wherein the one frame period is divided into four fields including a red field configured to display a red screen, a green field configured to display a green screen, a blue field configured to display a blue screen, and a white field configured to display a white screen.

9. The liquid crystal display device according to claim 1, wherein input gradation data for one color is divided into a plurality of field data, and a plurality of drive voltages corresponding to the plurality of field data are respectively applied to the liquid crystal panel in the plurality of fields, for display based on the input gradation data for the one color.

10. The liquid crystal display device according to claim 1, wherein the liquid crystal panel comprises:

a pixel electrode to be disposed in a matrix;

a common electrode disposed to face the pixel electrode;

a liquid crystal interposed between the pixel electrode and the common electrode;

a scanning signal line;

a video signal line to be applied with a video signal in accordance with the writing gradation data; and a thin film transistor with a control terminal for connecting to the scanning signal line, a first conduction terminal for connecting to the video signal line, a second conduction terminal for connecting to the pixel electrode, and a channel layer being formed with an oxide semiconductor.

11. The liquid crystal display device according to claim 10, wherein the oxide semiconductor mainly includes indium, gallium, zinc, and oxygen.

12. A driving method for a liquid crystal display device configured to display an image by dividing one frame period into a plurality of fields and applying, to a liquid crystal panel, for each field, writing gradation data corresponding to a drive voltage, the method comprising:

a stable arrival gradation data acquisition step of acquiring stable arrival gradation data indicating an arrival gradation estimation value at a start timing of each field of a last frame in a case where a virtual display process of three or more frames is performed based on input gradation data for one frame;

an input gradation data compensation step of acquiring the writing gradation data by compensating the input gradation data based on the stable arrival gradation data; and a liquid crystal panel drive step of driving the liquid crystal panel based on the writing gradation data, wherein in the stable arrival gradation data acquisition step, the stable arrival gradation data is acquired by repeatedly performing, for each field, an arrival gradation value estimation process for acquiring, based on input gradation data for an object field and an arrival gradation estimation value at a start timing of the object field, an arrival gradation estimation value at a start timing of a next field in a case where a drive voltage for achieving display luminance corresponding to input gradation data is applied to the liquid crystal panel in an object field, in the input gradation data compensation step, the writing gradation data is acquired to achieve the display luminance corresponding to the input gradation data in the plurality of fields, in a case where an arrival gradation value at a start timing of each of the plurality of fields serves as an arrival gradation estimation value indicated by the stable arrival gradation data, in the stable arrival gradation data acquisition step, a plurality of arrival gradation value estimation processes are performed, each of the plurality of arrival gradation value estimation processes comprising:

receiving first input data and second input data, and to acquire application gradation data corresponding to a drive voltage for achieving display luminance corresponding to the first input data in an object field, in a case where an arrival gradation value at a start timing of the object field serves as an arrival gradation estimation value indicated by the second input data; and receiving the second input data and the application gradation data, and to acquire, in a case where the arrival gradation value at the start timing of the object field serves as the arrival gradation estimation value indicated by the second input data, field arrival gradation data indicating an arrival gradation estimation value at a start timing of a next field in a case where a drive voltage corresponding to the application gradation data is applied to the liquid crystal panel, input gradation data for an object field is given, as the first input data, to each of the plurality of arrival gradation value estimation processes, and in a case where two arrival gradation value estimation processes provided to correspond to two consecutive fields for a virtual display process are defined as a preceding arrival gradation value estimation process and a succeeding arrival gradation value estimation process, field arrival gradation data acquired included in the preceding arrival gradation value estimation process is given, as the second input data, to the succeeding arrival gradation value estimation process.

* * * * *